US005850694A

United States Patent [19]

Maejima

[11] Patent Number: 5,850,694

[45] Date of Patent: Dec. 22, 1998

[54] TERMINAL INSERTION APPARATUS AND TERMINAL POSTURE CORRECTING DEVICE AND METHOD

[75] Inventor: Takamichi Maejima, Haibara-gun, Japan

[73] Assignee: Yazaki Corporation, Tokyo, Japan

[21] Appl. No.: 684,856

[22] Filed: Jul. 25, 1996

[30] Foreign Application Priority Data

Jul. 26, 1995 [JP] Japan ..... 7-190578

[51] Int. Cl.[6] ..... H01R 43/00

[52] U.S. Cl. ..... 29/884; 29/748; 29/881

[58] Field of Search ..... 29/33 F, 564.2, 29/564.6, 748, 831, 881, 884

[56] References Cited

U.S. PATENT DOCUMENTS

| | | | |
|---|---|---|---|
| 5,414,925 | 5/1995 | Mishide et al. | 29/748 |
| 5,588,206 | 12/1996 | Maejima et al. | 29/748 |
| 5,657,535 | 8/1997 | Maejima | 29/748 |

*Primary Examiner*—W. Donald Bray
*Attorney, Agent, or Firm*—Armstrong, Westerman, Hattori, McLeland, & Naughton

[57] ABSTRACT

A terminal insertion apparatus includes a terminal insertion head having a pair of wire catching hands and a terminal guiding piece and being movable along a Y-axis beam by servo drive, a high speed transfer belt having an electric wire clamp and being movable in the X-axis direction by servo drive, and a terminal posture correcting device having a pair of chuck pieces for chucking the terminal of a terminal end on the wire clamp and delivering it to the wire catching hands and a terminal holder and being movable by servo drive in a direction in parallel to that of the high speed transfer belt. Using the terminal insertion apparatus, the posture of the terminal is corrected two-dimensionally, and the terminal is inserted into a connector housing along the terminal guide pieces. The chuck pieces which is apart from a terminal at a certain position advances to pass the terminal therebetween, chuck the terminal, and retreat to cause the terminal to abut on a terminal stopping step. The terminal holder advances to abut on the terminal. In order that the terminal hits on the center of a guide face, the terminal is held in its inclined state, or the height of an insertion head is adjusted. Thus, the posture of the terminal can be surely corrected and the terminal can be surely inserted into a connector.

16 Claims, 22 Drawing Sheets

FIG. 16A
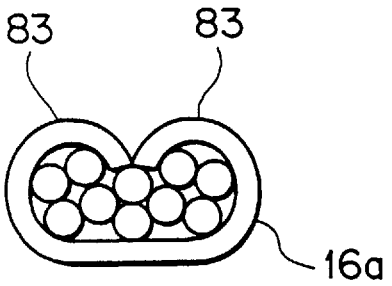
FIG. 16B
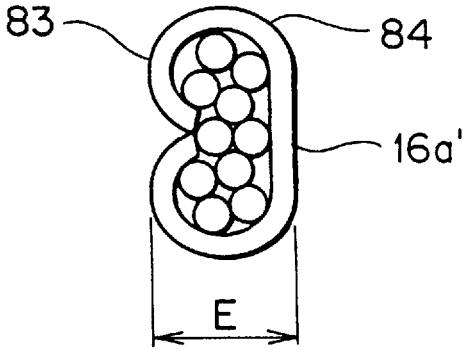
FIG. 17C
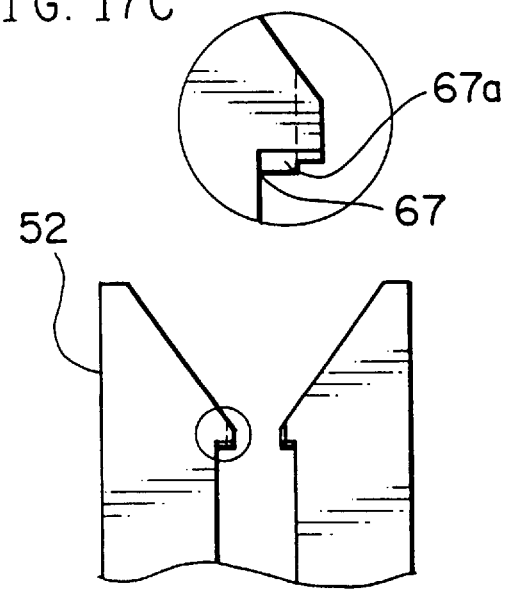
FIG. 17A
FIG. 17B
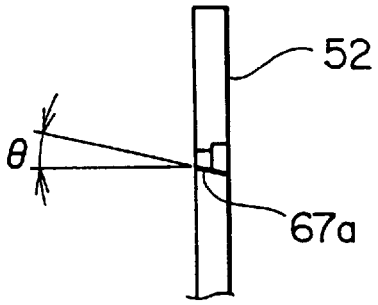

TERMINAL INSERTION APPARATUS AND TERMINAL POSTURE CORRECTING DEVICE AND METHOD

BACKGROUND OF THE INVENTION

1. Field of the Invention

The present invention relates to a terminal posture correcting device and method which can correct the posture of a wire-equipped terminal, and to a terminal insertion apparatus and method which can surely insert a terminal with its posture stabilized by the terminal correcting device into a connector housing by means of a terminal insertion head.

2. Description of the Prior Art

FIG. 29 shows a terminal posture correcting device, generally 91, adopted in a conventional terminal insertion apparatus disclosed in JP-A-63-148582.

This terminal posture correcting device 91 includes an electric wire clamp 95 for clamping a terminal end 94 (inclusive of a terminal 92 and an electric wire 93 connected thereto), a pair of terminal catching tools releasably located above and below the terminal 92, and a cylinder 97 for vibrating the pair of terminal catching tools. In operation, with the electric wire 93 clamped by the electric wire clamp 95, the terminal 92 is caught or held by the pair of catching tools 96. Then, the catching tools 96 are vibrated vertically to bend the electric wire 93, thus removing the curve or bend of the electric wire 93. Thus, since the posture of the terminal 92 for a connector housing (not shown) is stabilized, the terminal can be surely inserted in the connector housing by means of a terminal insertion head (not shown).

However, since the above conventional terminal correcting device must vibrate the end terminals one by one, it takes a relatively long time for the posture correcting device 91 to correct the terminal posture. In addition, since the above terminal correcting device 91 can correct only the vertical bend of the terminal end 94, insertion of the electric wire 93 bent horizontally may end in failure.

On the other hand, FIGS. 30 and 31 illustrate the conventional terminal insertion method proposed in Japanese Patent Appln. 5-310273.

As seen from FIG. 30, inside a pair of terminal guide pieces 32 for carrying out both operations of sharing of electric wires 17 and guiding of terminals 16, a transverse guide face 100 and an upper guide face 81 are formed. The tip of the terminal 16 slides along both guide faces 81 and 100, and is guided into a terminal chamber 86 of a connector housing 34. The terminal 18 is preferably linearly inserted into the center the terminal chamber 86. For this purpose, the upper tip of the terminal 16 must be located on the lower end of the upper guide face 81. But, it is very difficult to stabilize the terminal posture precisely at such a position.

Further, as shown in FIG. 31A, where the terminal end is located at a slightly more upper position than the center of the terminal chamber, targetting the center of the upper guide face 81, the terminal 16 will be inserted with its front bent downward into a connector housing as shown in FIG. 31B. As a result, the terminal may be entangled inside the terminal chamber, and hence the electric wire 17 may disadvantageously be buckled.

SUMMARY OF THE INVENTION

An object of the present invention is to provide a terminal posture correcting device and method which can correct the bend of a wire-equipped terminal (i.e., terminal end) quickly and surely so as to stabilize the posture of the terminal, and to a terminal insertion apparatus and method which can surely insert a terminal with its posture stabilized by the terminal correcting device into a connector housing by means of a terminal insertion head.

In order to attain the above object, the present invention adopts a terminal insertion apparatus comprising: a Y-axis beam movable by servo drive along an X-axis beam; a terminal insertion head having wire catching hands and a terminal guiding piece and slidably engaged with said Y-axis beam, said terminal insertion head being movable toward a connector housing by servo drive; a high speed transfer belt having an electric wire clamp for clamping a wire of a terminal end and being movable in the X-axis direction by servo drive; and a terminal posture correcting device located at a forward position in a terminal insertion direction of said electric wire clamp, being movable by servo drive in a direction in parallel to that of said high speed transfer belt, said terminal posture correcting device including a pair of chuck pieces for chucking a terminal of the terminal end clamped by said wire clamp and delivering said terminal end to said wire catching hands and a terminal holder which is movable in a direction perpendicular to the opening/closing direction of said terminal chuck pieces.

The present invention also adopts a terminal posture correcting device comprising: a pair of terminal chuck pieces, each including a straight inner side face which can catch a terminal of a terminal end, a terminal stopping step perpendicular to said inner side face and an inclined guide portion for terminal introduction formed from said terminal stopping step to a tip of each of the terminal chuck pieces; and a terminal holder which is movable along said pair of terminal chuck pieces and can hold the terminal between itself and said terminal stopping step.

The terminal posture correcting device further comprises a first cylinder for said opening/closing said chuck pieces; a second cylinder for shifting said terminal holder along said first cylinder; and a third cylinder for shifting said first and said second cylinder integrally in a terminal direction of the terminal end clamped by an external wire clamp, whereby said chuck pieces can be located at three positions for said terminal by an expansion/contraction operation of said third cylinder.

The terminal posture correcting device can have a structure in which said terminal holder is located before and after said terminal chuck pieces in a direction of a plate thickness and extends to traverse a gap between said pair of terminal chuck pieces in an opening state, and includes a pair of terminal supporting rods each movable toward said terminal stopping step and a terminal supporting protrusion provided in one of said terminal supporting rods and positioned in said gap between said pair of terminal chuck pieces.

The terminal posture correcting device can have a structure in which the tip of each of said pair of terminal supporting rods is sharp in a wedge-shape, said terminal supporting protrusion protrudes in a more degree in a terminal direction than said pair of terminal supporting rods, and a tip of said terminal supporting protrusion is inclined by about 2° for a guide surface of each of said terminal guide pieces of said terminal insertion head.

The terminal posture correcting device can have a structure wherein said terminal stopping step is inclined by about 2° for the guide faces of said terminal guide pieces; wherein an opening angle of the inclined guide faces of said pair of terminal chuck pieces is not larger than 70°; wherein the tips of said inclined guide portions are rounded; wherein protrusions constituting said terminal stopping steps are arranged in a offset manner at the front of the one of said terminal chuck pieces and the rear of the other thereof, respectively, in a direction of their plate thickness, and when both terminal chuck pieces are closed, both protrusions thereof overlap to decrease the gap between both terminal chuck pieces; and wherein said terminal chuck pieces and said terminal supporting protrusion are formed to have a smaller thickness than the length of a wire crimping portion of the terminal so that they support a wire crimping portion of the terminal.

A terminal posture correcting method according to the present invention comprises the steps of: advancing a pair of terminal chuck pieces in a direction perpendicular to that of a terminal of a terminal end whose wire clamped by a wire clamp thereby to pass the terminal through said pair of terminal chuck pieces; closing said terminal chuck pieces to chuck the terminal; releasing chucking force of the terminal chucking pieces; retreating said terminal chuck pieces in a direction perpendicular to the terminal so that the terminal abuts on a terminal stopping step of each of said terminal chuck pieces; advancing a terminal holder toward to said terminal; and holding said terminal between said terminal stopping step and said terminal holder.

Actually, the terminal posture correcting method using the terminal posture correcting device as defined above according to the present invention can comprise the steps: by a contracting operation of said third cylinder to a maximum degree, positioning inclined guide portions of a pair of chuck pieces oppositely in a direction perpendicular to that of a terminal of a terminal end whose wire clamped by a wire clamp; by a extending operation of said third cylinder to a maximum degree, passing said terminal between said pair of terminal chuck pieces; applying a pressure to said first cylinder so as to close said pair of terminal chuck pieces so that the posture of said terminal is corrected in a width direction; and placing said first cylinder in an exhaust center state to release chucking force of said terminal chucking pieces so that by an intermediate contraction operation of said third cylinder, the terminal stopping steps of said pair of terminal chuck pieces are caused to abut on the one end of said terminal and by said second cylinder, said terminal holder is caused to abut on the other end of said terminal, thereby correcting the posture of said terminal in a height direction.

Further, the terminal insertion method according to the present invention can further comprise the steps of: by said wire catching hands, catching the wire of the terminal end whose terminal is chucked by said terminal chuck pieces, thereby releasing urging force of said terminal holder; opening said terminal chucking pieces to move said terminal insertion head in front of a connector housing and advance said wire catching hands so that the terminal is inserted into said connector housing along said terminal guide pieces.

The terminal insertion method using the terminal insertion apparatus as defined above according to the present invention, comprises the steps: by an shifting operation of a high speed transfer belt, locating said wire clamp behind a required one of a plurality of connector housings arranged on a pallet; shifting said posture correcting device towards said wire clamp simultaneously with the shifting operation of the high speed transfer belt so that said terminal chuck pieces are positioned oppositely to the front of said wire clamp so that the posture of the terminal of the terminal end whose wire is clamped by said wire clamp is two-dimensionally corrected by said terminal chuck pieces and said terminal holder of said terminal posture correcting device; causing said wire catching hands to receive said terminal from said terminal chuck pieces; moving said terminal insertion head to a vicinity of the required connector housing along said Y-axis beam; and advancing said wire catching hands to insert the terminal into the required connector housing along the terminal guide pieces of said terminal insertion head.

In a terminal insertion method comprising the steps of shifting a terminal insertion head having wire catching hands and terminal guide pieces in a Z-axis direction by a ball screw unit by servo drive; catching a terminal clamped by an external wire clamp by said wire catching hands; taking up it in a Z-axis direction by a contract operation of a cylinder for shifting said wire catching hand; and inserting the terminal of said terminal end along terminal guide pieces, the present invention is characterized in that when said terminal insertion head intends to catch the terminal end clamped by said wire clamp by an operation of the ball screw unit, the shifting amount of said ball screw unit is changed in accordance with a distance in the Z-axis direction from a tip of said wire to the center position of the guide faces of said guide pieces so that the tip of said terminal after said cylinder contracts said wire by a prescribed length is positioned at a center of said guide face.

In a terminal insertion method comprising the steps of shifting a terminal insertion head, having a wire catching hand and a cylinder for shifting it, in a Z-axis direction so that the terminal end clamped by an external wire clamp is caught and. taken up by said wire catching hands, and shifting said wire catching hands by said cylinder in a Y-axis direction to insert the terminal of said terminal end into the connector housing, the present invention is characterized in that said terminal insertion head is movable by servo drive along a Y-axis beam; before the end terminal clamped by said wire clamp is caught by said wire catching hand, said terminal insertion head is shifted, in accordance with the Y-axis length of the terminal and connector housing by servo drive along the Y-axis beam so that the terminal catching position in the Y-axis direction by said wire catching hands is defined, thereby acquiring a terminal complete insertion stroke based on a total of a stroke of said cylinder and the shifting amount of said terminal insertion head.

In accordance with the terminal insertion device and method and the terminal posture correcting device and method, the terminal on the wire clamp and the terminal posture correcting device can approach a required connector housing. The terminal and the terminal posture correcting device can be moved independently of each other because the chuck pieces are located on the lower side of a terminal end, and the chuck pieces can move linearly e.g. in a vertical direction with no useless movement, thus speeding up the terminal posture correction and terminal insertion operation. Thus, the horizontal posture of the terminal can be corrected by the inner side of a pair of chuck pieces whereas the vertical posture of the terminal can be corrected by the terminal holder, thus correcting the terminal posture accurately. This improves the success rate of terminal insertion. Additionally, since the terminal supporting rod is located to traverse between a pair of chuck pieces, the terminal can be surely held without falling away from the chuck pieces.

Since the terminal supporting protrusion and the chuck pieces form an inclination of angle of about 2°, the posture of the terminal is corrected inclinedly, and the tip of the terminal held by the terminal insertion head is located oppositely to the guide faces of the terminal guide pieces, and the wire of the terminal end is located in the same axis as the terminal chamber, thus permitting the terminal insertion to be smoothly and surely.

The inclined guide portion serves to introduce the terminal between the chuck pieces smoothly. The roundness of the tip of the chuck pieces prevents the terminal from being damaged when the terminal is introduced.

The protrusions out of phase from each other of a pair of chuck pieces and the terminal stopping step can decrease the gap between the chuck pieces when they are closed. This permits a thin-type terminal to be caught and the terminals having various sizes to be delt with.

The thin-type chuck pieces and terminal holders can hold the wire crimping portion of the terminal with high machining precision, thus improving the precision of correcting the terminal posture.

In the terminal insertion method according to the present invention, the tip of the terminal can be brought into slidable contact with the center of the guide faces of the terminal guide pieces. For this reason, even if there are changes in the posture of the terminal, the tip of the terminal will not come off from the guide surface so that the terminal can be surely guided into a connector housing. Further, the drive operation of the ball screw unit permits the tip of the terminal having any size to be positioned at the center of the guide surface, thereby increasing versatility.

Further, in the terminal insertion method according to the present invention, the stroke of inserting a terminal can be adjusted in accordance with the length of various kinds of terminals and connector housing, thereby increasing versatility. Further, unlike the prior art, it is not necessary to set an excessive amount of insertion stroke to loosen the wire so that the immediate rear of the wire can caught by the wire catching hand. Thus, the posture of the terminal end after delivered to the chuck pieces of the terminal posture correcting apparatus can be further stabilized. In addition, since there is no loosing of the wire, forcible sharing of wires can be smoothly carried out, thus improving easiness of terminal insertion.

The above and other objects and features of the present invention will be more apparent from the following description taken in conjunction with the accompanying drawings.

BRIEF DESCRIPTION OF THE DRAWINGS

FIGS. 16A and 16B are a sectional view of a wire crimping portion of a terminal, and a sectional view of its 90° inverted state;

FIGS. 17A and 17B are a front view of other chuck pieces and its internal side view, respectively;

FIG. 17C is an enlarged view of the section of FIG. 17A within the circle shown in FIG. 17A.

DESCRIPTION OF THE PREFERRED EMBODIMENTS

Figure 1:
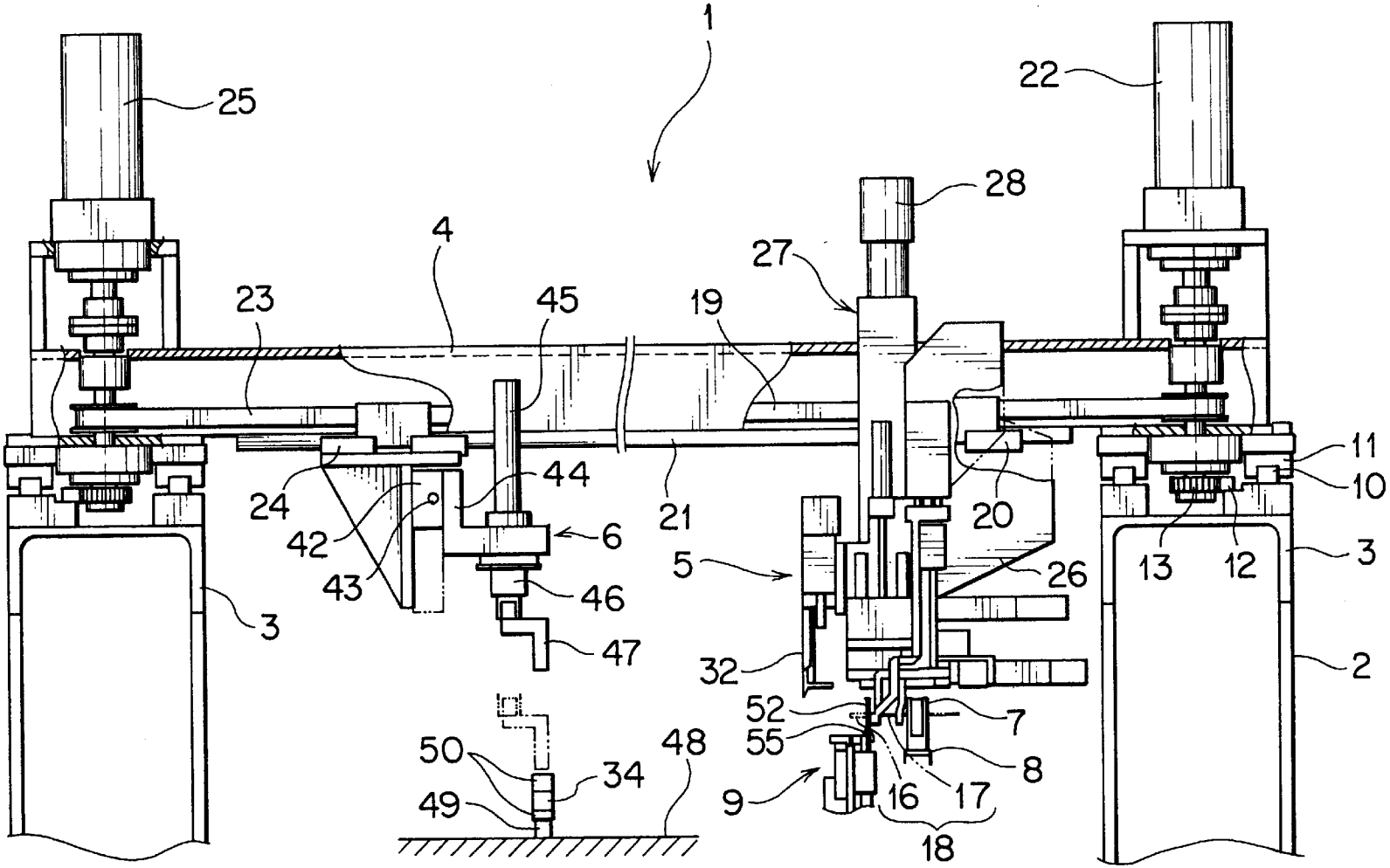
FIG. 1 is a side vide showing an embodiment of the terminal insertion device according to the present invention.

The terminal insertion apparatus according to the present invention includes a terminal insertion head movable on X–Y axis beams, a clamp-equipped high speed transfer belt which can shift a terminal end (wire-equipped terminal) towards a terminal insertion head, and a terminal posture correcting device located at the forward positon of the transfer head in a direction of inserting a terminal into a connector housing. The terminal posture correcting device may be arranged on not only the lower side of a terminal insertion head but also on the side thereof(Namely, the terminal posture correcting device as shown in FIG. 1 may be inverted by 90°).

The terminal insertion method according to the present invention comprises the steps of: chucking a terminal by a pair of chuck pieces of the terminal posture correcting device to stabilize the posture of the terminal, and with the terminal held by a terminal insertion head, inserting the wire into a connector housing. The posture correcting device includes a terminal holder movable along chuck pieces.

The terminal insertion head, as proposed in Japanese Patent Appln. No. 5-310273 and Japanese Patent Appln. No. 6-89507, includes electric wire catching hands, a terminal guide, etc. On the other hand, the present invention proposes a method for inserting various kinds of terminals into various kinds of connector housings comprising the steps of shifting a terminal insertion head in a Z-axis direction by means of shifting means such as a ball screw unit by servo drive to guide a terminal so that its tip is located at the center of upper guide faces of terminal guide pieces; and shifting the terminal insertion head by servo drive along an X-axis or Y-axis so that the catching position in a terminal insertion direction is previously defined in accordance with the kind of each of various terminals when the terminal end chucked by said chucks and clamp is caught, thereby completely inserting each of the terminals into each of the connector housings.

Now referring to the drawings, an explanation will be given of a concrete example of the embodiments of the present invention.

Figure 2:
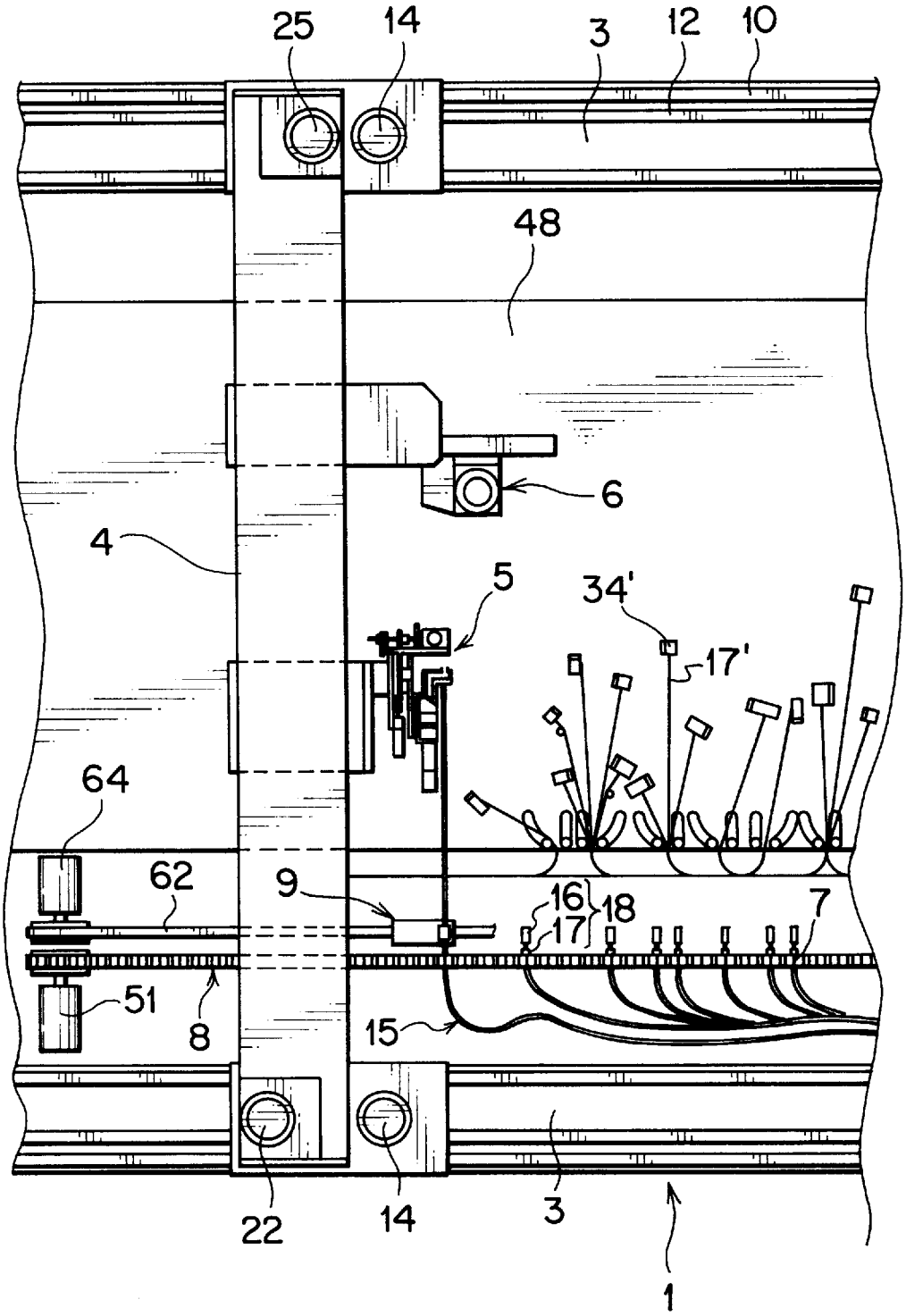
FIG. 2 is a plan view showing an embodiment of the terminal insertion device according to the present invention.

FIGS. 1 to 2 are views showing the entire configuration of a terminal insertion apparatus, generally 1, according to the present invention.

The terminal insertion apparatus 1 includes a pair of X-axis beams 3 hooked on a frame 2; a Y-axis beam shiftably supported on said pair of X-beams 3; a terminal insertion head 5 shiftable along the Y-axis beam 4; a connector holding unit 6 shiftable along the Y-axis beam 4 and located oppositely to the terminal insertion head 5; a plurality of electric wire clamps 7 located on the lower side of the terminal insertion head 5; a high speed transfer belt (timing belt) for shifting the plurality of electric wire clamps in a direction (X-direction) orthogonal to the Y-axis beam 4; and a terminal posture correcting device 9 which is located at a forward position in a terminal insertion direction of the electric wire clamps 7 and can be shifted at a high speed by a transfer belt (timing belt) 62 in a direction in parallel to the high speed transfer belt 8.

The Y-axis beam 4 is driven by an X-axis servo motor 14 (FIG. 2) with an LM (linear movement) guide 11 engaged with a rail 10 on the X-axis beam 3 and with a pinion 13 toothing a rack 12. In FIG. 2, another Y-axis beam (not shown) is provided on the right side of the Y-axis beam of the Y-axis beam 4, and both Y-axis beams 4 share one and the other terminal end (each generally inclusive of a terminal 16 and a wire connected thereto) of a single terminal-equipped wire caught by the clamp 7 on the high speed transfer belt 8, respectively. The terminal transfer belt 8 is installed near the one X-axis beam 3. In the state where the terminal insertion head 5 is located at the stem of the Y-axis beam 4, the terminal insertion head 5 is vertically opposite to the electric wire clamps 7 and terminal posture correcting device 9.

The terminal insertion head 5 coupled with a first timing belt 19 (FIG. 1) that is shiftable in the Y-axis beam 4 is driven by a first servo motor 22 on the Y-axis beam 4 with an LM guide 20 engaged with the rail 21 of the Y-axis beam 4. The connector holding unit 6 is coupled with a second timing belt 23 is driven by a second servo motor 25 with an LM guide 24 engaged with the rail 21. The servo motors 22 and 25 and timing belts 19 and 23 are arranged out of phase as shown in FIG. 2.

The terminal insertion head 5 includes a frame 26 successive to the LM guide 20, a first substrate 89 vertically movably engaged with the frame 26 through a ball screw unit 27, a second substrate 30 vertically movably engaged with the first substrate 89 through a vertical cylinder 29 which shifts the wire ca-tuhing hards in a Z-axis direction, a terminal guide unit 31 provided at the front end of the first substrate 89, and a terminal end catching unit 35 provided on said substrate 30. The ball screw unit 27, including a servo motor 28 (FIG. 1) and a rotary ball screw (not shown), can move the insertion head 5 itself. The arrangement of the terminal insertion head 5 has been already proposed in Japanese Patent Appln. Nos. 5-310273 or 6-89507.

The terminal guide unit 31 includes a pair of terminal guide pieces 32 and a chuck cylinder 33 for opening or closing the guide pieces 32. The terminal guide pieces 32 serve to share forcibly electric wires 17' introduced from the connector housing 34 and guide the terminal 16 into a terminal chamber within a housing 34. The terminal catching unit 35 includes a pair of front catching hands 36 and a pair of rear wire catching hands 37 for the wire 17 of the terminal end 18, a chuck cylinder 38 for opening/closing the rear catching hands 37, an upper horizontal cylinder (primary shift cylinder of the electric catching hands) 40 for moving the front catching hands 36 together with the rear catching hands 37 and terminal end catching unit 35, and a horizontal cylinder (secondary shift cylinder of the electric wire catching hands) 41 for moving the rear catching hands 37 together with the chuck cylinder 39.

The connector holding unit 6 (FIG. 1) which has been proposed in another Japanese Patent Application (H7-203344) includes a short X'-axis beam 44 movable in a horizontal direction (X-direction) by a ball screw axis 43 hooked in the frame 42, a vertical cylinder 45 rotatably supported by the X'-axis beam 44, a chuck cylinder 46 coupled with the vertical cylinder 45 and a pair of connector holding chucks 47 provided on the chuck cylinder 46. The holding chucks 47 are adapted to be rotatable in accordance with the arrangement angle of the connector housing 34 by a rotary actuator (not shown). A connector housing 34 is held in a receiving jig 50 removably engaged with a receiving base 49 on a shaping pallet 48. The connector housing is lifted by the holding chucks 47 together with the receiving jig 50 so that it is positioned oppositely to the terminal insertion head 5.

Figure 4:
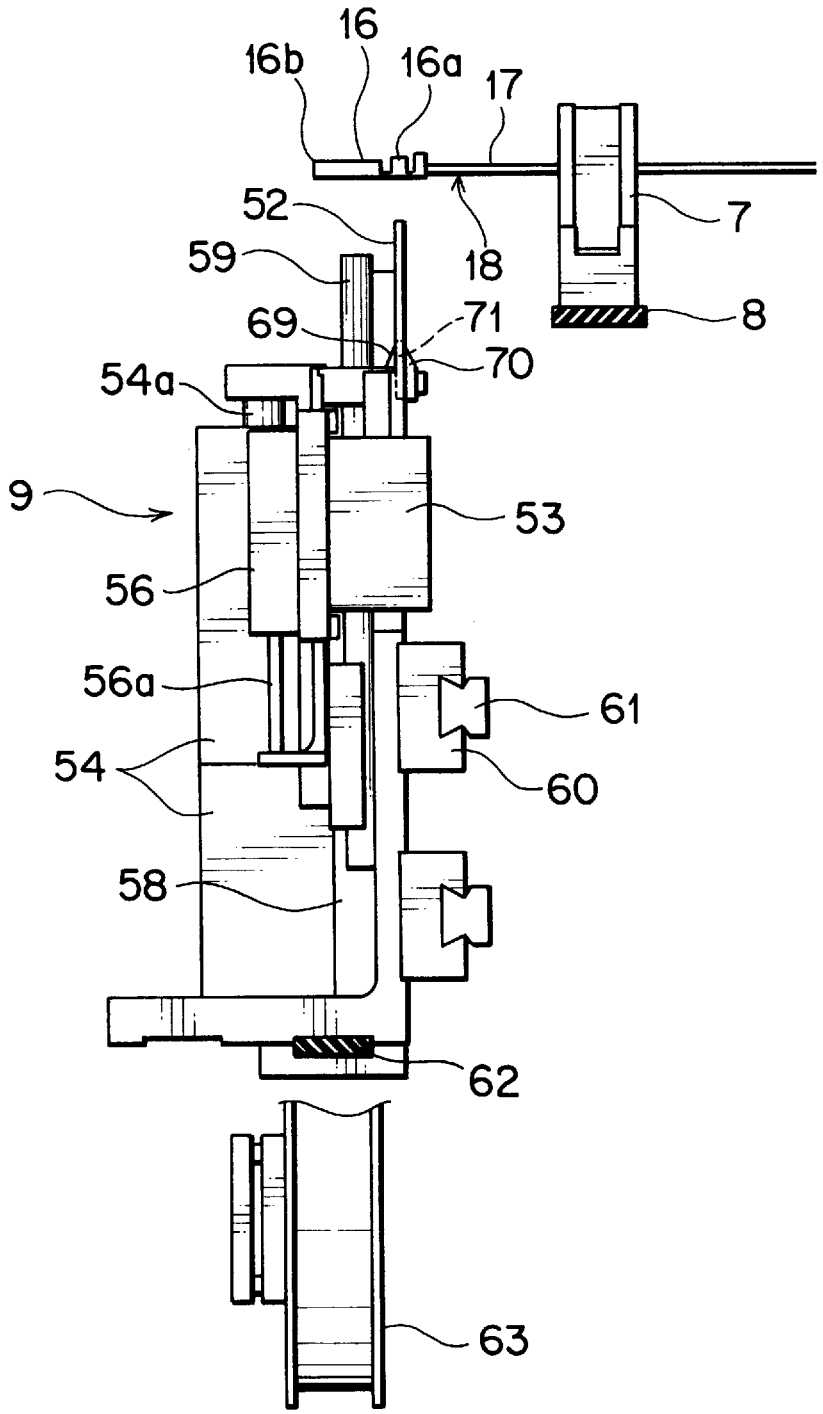
FIG. 4 is a side view of a terminal posture correcting device.

With the terminal 5 placed on the one end of the Y-axis beam 4, the high speed transfer belt 8 located on the lower side of the terminal head 5 has a plurality of wire clamps 7 urged to be closed, and with the electric wire 17 of the terminal end 18 clamped by a certain clamp 7, can shift a required terminal 16 in the vicinity of a required connector housing by means of the servo motor 51 as shown in FIG. 2. As shown in FIG. 4, the high speed transfer belt 8 continues endlessly in a loop shape.

Figure 9:
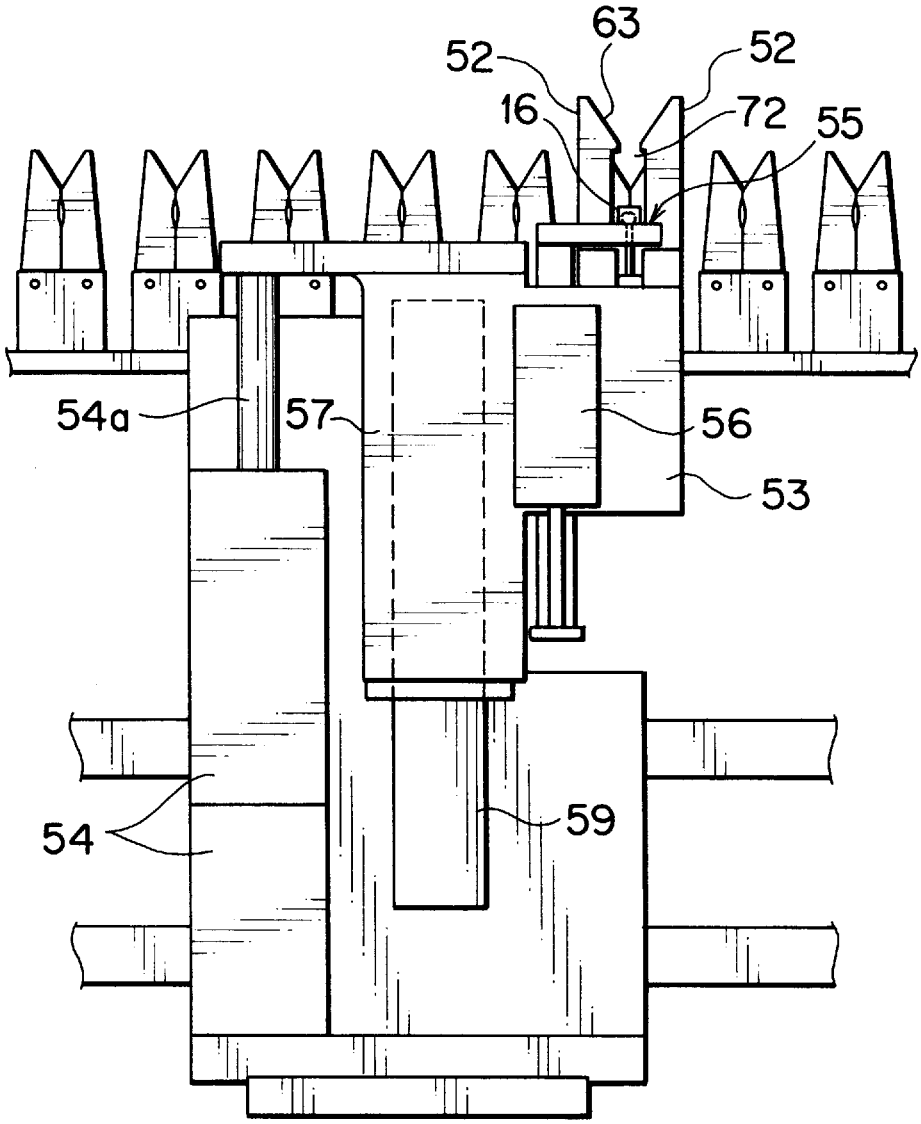
FIG. 9 is a front view of the state where a terminal has been passed between chuck pieces of the terminal posture correcting device.

At a forward position of the high speed transfer belt 8 in a terminal insertion direction, the terminal posture correcting device 9 is opposed to the transfer belt 8. The terminal posture correcting device 9, as shown in FIG. 9, includes a pair of upward terminal chuck pieces (hereinafter referred to as "chuck pieces") 52 for chucking a wire crimping portion 16*a* (where a conductor of the covered electric wire 17 is crimped), a chuck cylinder 53 for opening/closing the chuck pieces 52, a vertical two-stage cylinder 54 for vertically moving said chuck pieces 52 together with the chuck cylinder 53, a terminal holder 55 whose components are located on both sides in a direction of plate thickness of the chuck pieces 52 and a vertical cylinder 56 for vertically for moving the terminal holder 55.

The chuck cylinder 53 and the terminal holder shifting cylinder 56 are provided integrally to the slide block 57 which is slidably engaged with a vertical rail 59 at the center of the vertical substrate 58. The vertical substrate 58 is provided with the two-stage cylinder 54. The rod 54*a* of the two-stage cylinder 54 is coupled with the slide block 57. The vertical substrate 58 is engaged with a horizontal rail 61 through the LM guide 60 (FIG. 4). On the bottom of the vertical substrate 58, the belt 62 for horizontal shifting is arranged. The belt 62 is rotated by the servo motor 64 (FIG. 1) through a pulley 63. When the high speed transfer belt 8 is rotating, the two-stage cylinder 54 is in a most-contracted state so that the terminal end 18 and the chuck pieces 52 can be prevented from being interfered with each other. The two-stage cylinder 54 can selectively arrange the chuck pieces 52 at three (upper, intermediate and lower) positions.

Figure 5:
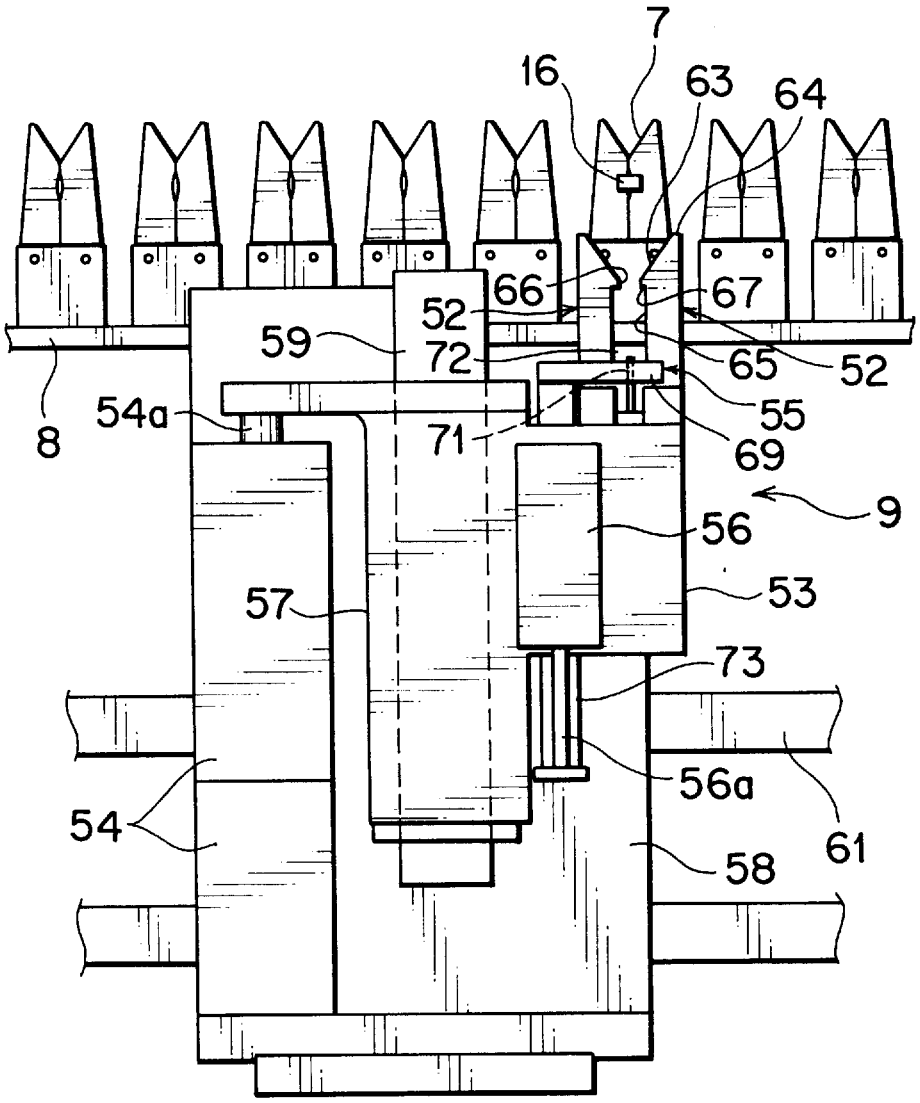
FIG. 5 is a front view showing the terminal posture correcting device.

The chuck pieces 52, as shown in FIG. 4, are formed to have a thickness substantially equal to the length of the wire crimping portion 16*a* of the terminal 16 or slightly smaller than it to obviate the flash-like protrusion (bell mouth) of the front and rear end of the wire crimping portion 16*a*. The chuck pieces 52 have inward tapered guides 63 (electric wire scooping portions) at their tips as shown in FIG. 5. The tip of each chuck piece 52 is not acute but has an R-shape roundness 64 so that the terminal end will not be damaged. The lower end of the tapered guide portion 63 protrudes more than the inner side 65 of the chuck piece 52. At this protrusion 66, a hook-shaped terminal stopping stage portion orthogonal to the inner side face 65 is formed. Between the stopping stage portion 67 and the terminal holder 55, the wire crimping portion 16*a* of the terminal 16 is fixed. The wire crimping portion 16*a*, which is crimped by a crimper and a anvil which are not shown, has both accurate width and height and the most suitable portion to be caught for posture correction.

The terminal holder 55 includes a pair of terminal supporting rods 69 and 70 which extend horizontally on both front and rear sides of the chuck piece 52 and a terminal supporting protrusion 71 extending vertically between the above pair of terminal supporting rods 69 and 70. The terminal supporting rods 69 and 70 traverse a slit-like gap 72 between the pair of chuck pieces in the most opened state of the pair of chuck pieces 52 to protrude their tip outwardly from the inner side 65 of the chuck piece 52. The bottom of the terminal 16 having various widths can be supported between the pair of chuck pieces 53 with no removal of the wire.

The terminal supporting protrusion 71 is located at the intermediate position of the gap 72 of the pair of chuck pieces 52, and supports the central position of the wire crimping portion 16*a* in the width direction of the terminal 16. The stem 55 of the terminal holder 55 is provided with a vertical coupling rod 73 which is extended to the lower side of the chuck cylinder 53. The coupling rod 73 is coupled with a rod 56*a* of the terminal holder shifting cylinder 56 provided at a handstand outside the chuck cylinder 53. The terminal holder 55 is located at the lowest position of the chuck piece 52 in the most extended state of the rod 56*a*.

Figure 7:
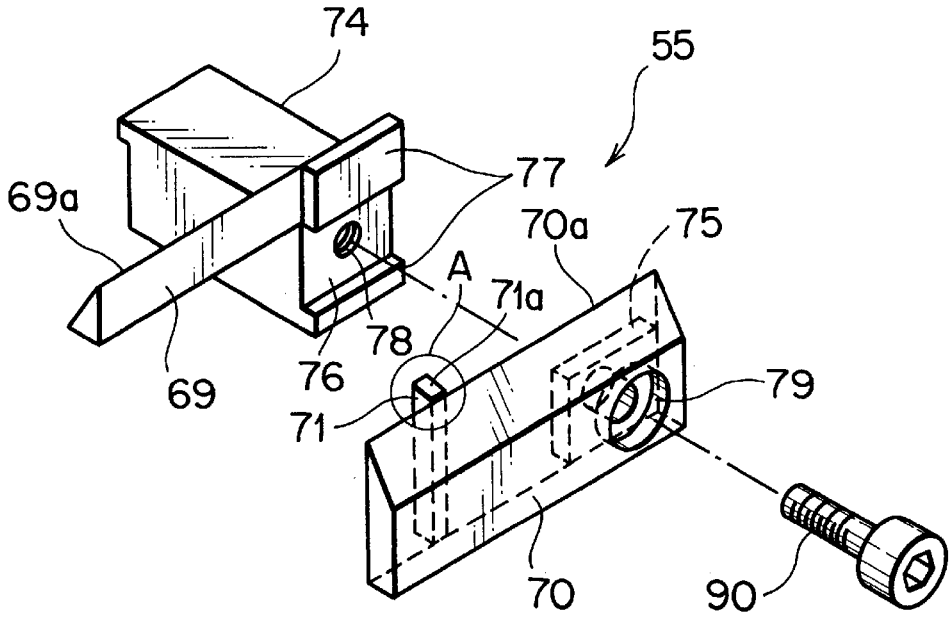
FIG. 7 is an exploded perspective view of a terminal holder in the terminal posture correcting device.
Figure 6:
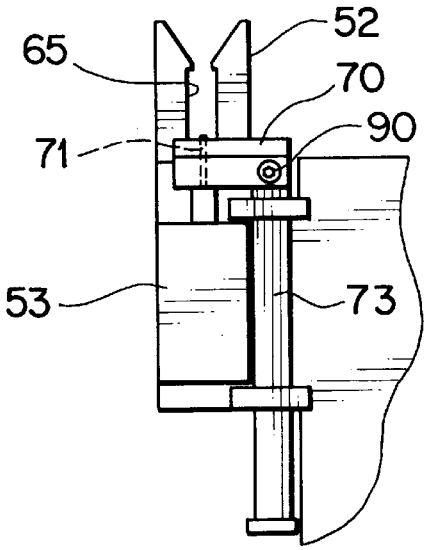
FIG. 6 is a background view of the terminal posture correcting device.

FIG. 7 is an exploded view showing the terminal holder 55. The terminal holder 55 includes a holder 74 having one supporting rod 69 of a sectional wedge (right triangle) protruding horizontally and the other supporting rod 70 opposite to and joined with the holder 74 by a bolt 90. The tip (upper end) of the other terminal supporting rod 70 is wedge-like sharp as the one terminal supporting rod 69 is. Their respective tips 69*a* and 70*a* can support the wire crimping portion 16*a* of the terminal 16. On the inner wall of the other supporting rod 70 are formed a square fitting convex portion 75 for the holder 74 and the vertical supporting protrusion 71 for the one supporting rod 69.

The holder 74 is provided with an engagement groove 76 corresponding to the fitting protrusion 75 and abutting convex portions 77 protruding toward the other supporting rod 70 above and below the engagement groove 76. The engagement concave portion 76 has a screw hole 78 passing through itself. The holder 74 and the supporting rod 70 are tightened and joined with each other by the bolt 90. The terminal supporting protrusion 71 is located within the gap between the one supporting rod 69 and the other supporting rod 70 to form passing-through portions for the pair of chuck pieces 52 on the right and left sides of the supporting protrusion 71.

Figure 8:
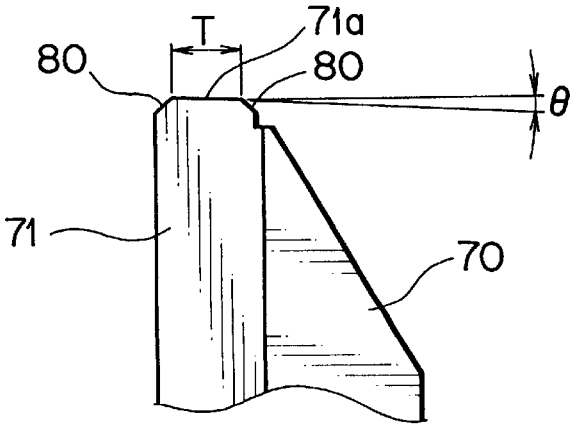
FIG. 8 is a side view of part A in FIG. 7.

The tip of the terminal supporting protrusion 71 protrudes more slightly upward than the tips of the supporting rods 69 and 70 as shown in FIG. 8. The shape of the protrusion end is tapered upward to the one supporting rod 69. The angle θ of tapering is set for about 2° so that the wire 16 can be supported slightly diagonal upward, thus capable of surely guiding the tip 16*b* of the terminal 16 in a sliding manner onto the upper guide surface 81 (FIG. 18) of the terminal guide pieces 32 described later. At the front and rear of the tip of the supporting protrusion 71, a bevelling 80 is formed as a escaping portion for the wire crimping portion 16*a* of the terminal 16. The width T of the supporting protrusion 71 other than the bevelling 80 is set for the maximum permissible size corresponding to the wire crimping portion 16*a* so that the terminal 16 hating any size can be supported, thus giving versatility for various terminal ends.

FIGS. 9 to 12 show the function of the above terminal posture correcting device 9.

FIG. 9 shows the state where the vertical two-stage cylinder 54 is extended from the most compressed state (where the chuck pieces 52 are located immediately below the terminal end 18 in FIGS. 4 and 5) so that the terminal 16 is passed through the gap 72 between the pair of chuck pieces 52. As the two-stage cylinder 54 is extended, the slide block 57 rises along the vertical rail 59. As a result, together with the slide block 57, the chuck cylinder 53 and chuck pieces 52, and the terminal holder 55 and the terminal holder shifting cylinder 56 are located at the top position.

In the state of FIGS. 4 and 5, the pair of chuck cylinders 52 have been already opened in substantially the maximum degree. The terminal end 18 clamped by the electric wire clamp 7 on the transfer belt 8 is brought into slidable contact with the tapering guide portion 63 to be guided between the pair of chuck pieces 52. Thus, it is located on the terminal holder 55. In FIG. 9, the terminal holder 55 is located at the lowest position of the chuck pieces 52. in FIG. 4, although the terminal 16 is illustrated straight, it actually bent vertically and horizontally at random due to its own weight and wind pressure, inertial force, etc. while it is moved at a high speed by the high speed transfer belt 8.

Figure 10:
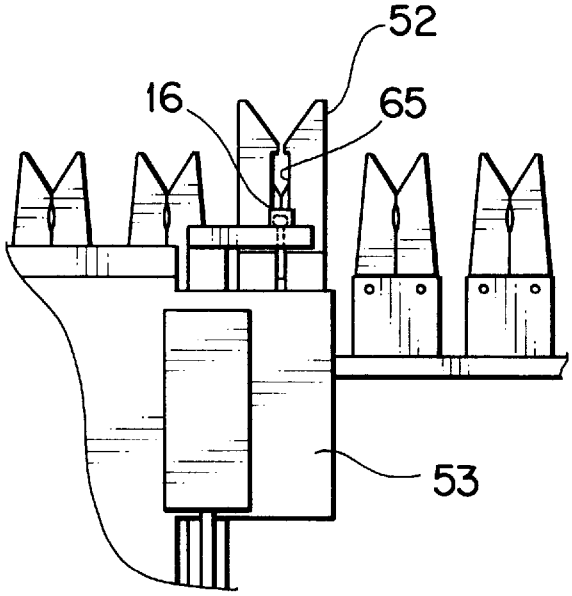
FIG. 10 is a front view of the state where the chuck pieces are closed.
Figure 11:
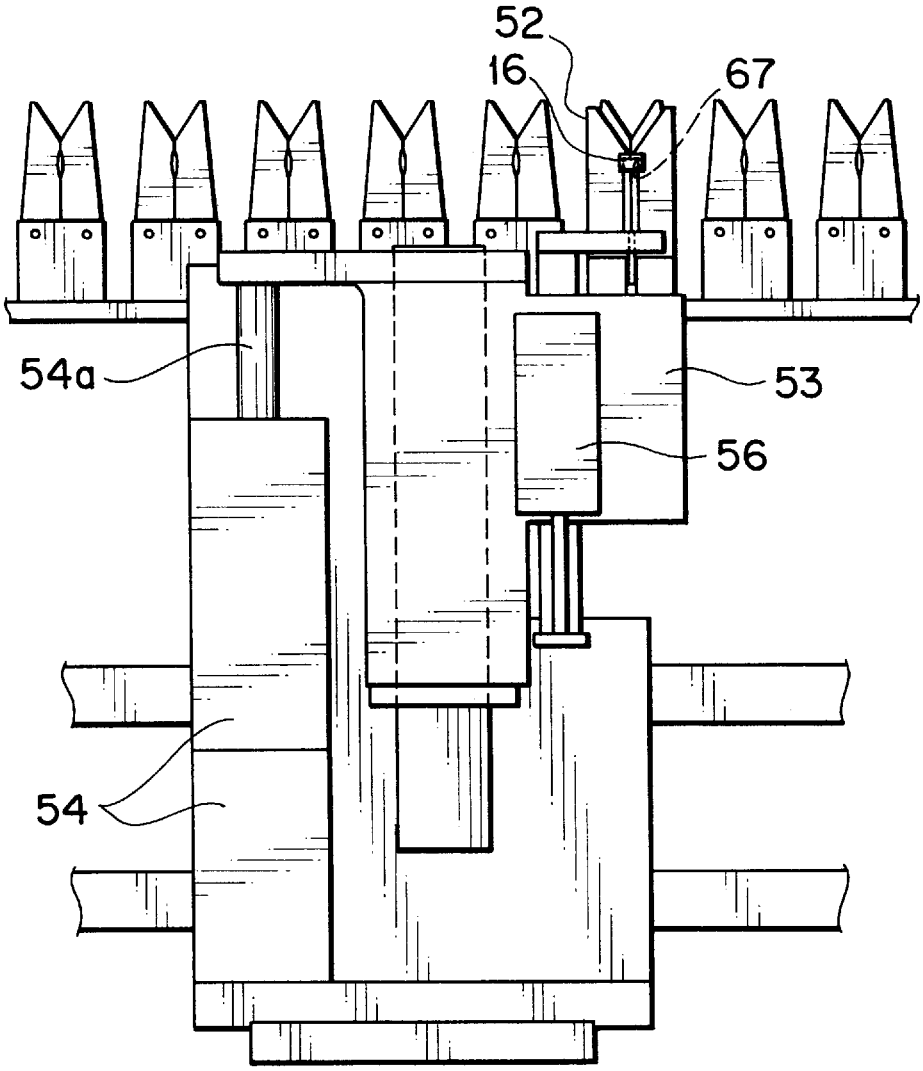
FIG. 11 is a front view of the state where the chuck pieces are lowered to catch the terminal.
Figure 13A:
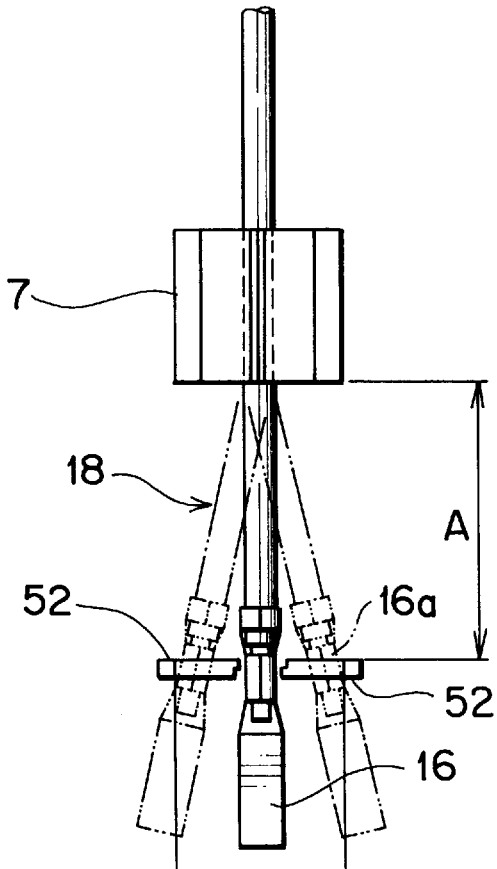
FIGS. 13A and 13B are a plan view showing the bend of a terminal and a front view of chuck pieces, respectively.
Figure 13B:
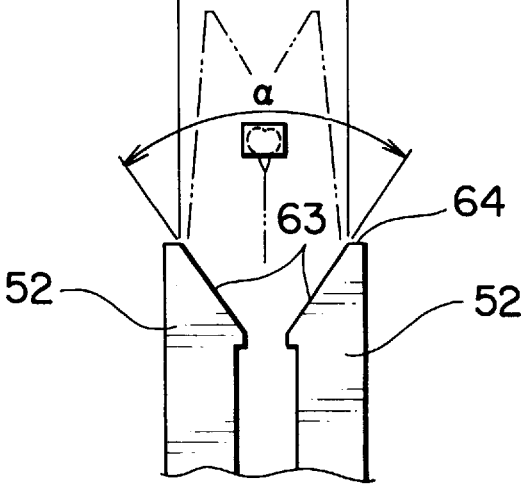

As shown in FIG. 10, the pair of chuck pieces 52 are closed so that the terminal 16 is stably supported or corrected with no horizontal swing. Thus, the terminal 16 is positioned horizontally. In this state, an air supply valve (not shown) for the chuck cylinder 53 for opening/closing the chuck pieces 52 is set at an exhaust center (air supply stopping) so that the chuck cylinder 53 is placed in a free state with no applied air pressure. Thus, the chucking state of the terminal 16 by the chuck pieces 52 is released so that the terminal 16 can be moved vertically along the inner side walls of the chuck pieces 52. From this state, as shown in FIG. 11, the rod 54*a* of the two-stage cylinder 54 is compressed to an intermediate position. Thus, the chuck pieces 52 fall together with the chuck cylinder 53 and the terminal holder shifting cylinder 56 and the wire crimping portion 16*a* of the terminal 16 is engaged with the stopping stage 67 above the chuck pieces 52 so that the termninal is positioned vertically. The chuck cylinder 53 remains at the exhaust center.

Figure 3:
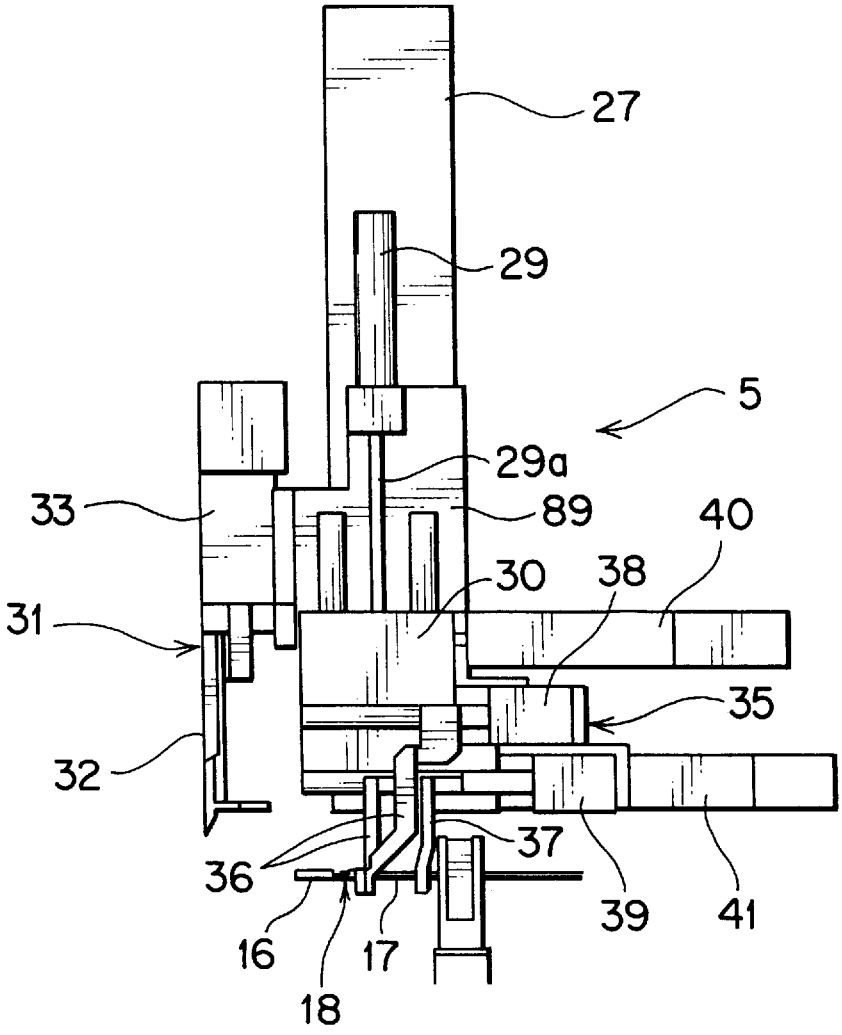
FIG. 3 is a side view showing a terminal insertion head.
Figure 12:
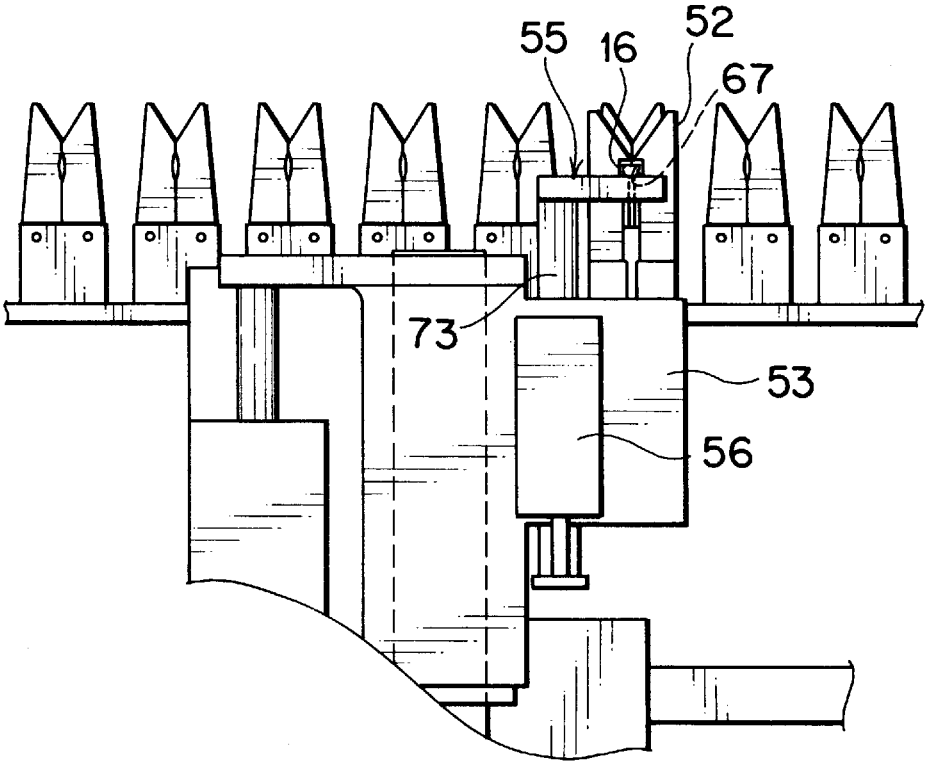
FIG. 12 is a front view of the state where the terminal holder is raised to siabilize the treminal posture.

As shown in FIG. 12, the terminal holder shifting cylinder 56 is compressed to raise the terminal holder 55 through the coupling rod 73. The wire crimping portion 16*a* of the terminal 16 is sandwiched between the terminal holder 55 and the stopping step 67 of the chuck pieces 52 and held stably in a height direction. In this state, the terminal 18 is delivered to the wire catching hands 36, 37 of the terminal insertion head 5 (FIGS. 1 and 3). When the wire catching hands 36 and 37 catch the terminal 18, the chuck cylinder 53 (FIG. 12) remains at the exhaust center, and the air bulb of the terminal shifting cylinder 56 is placed at the exhaust center before the terminal is delivered to the terminal insertion head 5 (i.e., before the chuck pieces 52 release the terminal 16). This is because when the chuck cylinder 53 and the terminal holder shifting cylinder 56, slight deviation of the timing from the normal timing may injure the terminal posture.

It should be noted that when the two-stage cylinder 54 in FIG. 11 is compressed, the falling operation of the chuck pieces 52 is carried out at substantially the same timing as that of the rising operation of the terminal holder 55 in FIG. 12. When the chuck pieces 52 release the terminal 18, the pressure supplied. to the terminal holder cylinder 56 is once set for the exhaust center. This intends to prevent the terminal holder 55 from pushing the terminal up so that the posture of the terminal may be disordered.

Correcting the posture of the terminal 18 permits the stabilized terminal posture to be taken without removing the bending tendency of the wire, thereby remarkably improving the success rate of inserting the terminal. With the posture of the terminal 18 corrected, catching the wire 17 immediately after the terminal 16 (in this case, the tip of the front wire catching hands 36 substantially abuts on the rear end of the terminal 16) can stabilize the posture of the terminal 18 in and after delivery. Thus, the terminal posture correcting device 9 including the above chuck pieces 52, although it has a relatively simple structure, can surely correct the posture of the terminal 18.

Further, by means of the high speed transfer belt 8, the terminal 18 can be moved to the vicinity of a required connector housing 34. By means of another high speed belt 62 which is independent of the movement of the high speed transfer belt 8, the terminal posture correcting device 9 can also be moved to the above position. In addition, precision of locating the terminal caribe assured by the use of the servo motors 51 and 64 so that the terminal can be inserted at a high speed. The terminal insertion at the high speed can be promoted by the other factor that with the chuck pieces 52 located immediately below the terminal 18, they are moved only in a height direction. Such a structure has been realized in such a manner that the chuck pieces 52 can be fallen or risen in two steps using the vertical cylinder 54. Interference or collision between the chuck pieces 52 and the terminal 18 can be prevented to permit the high speed transfer belt 8 and the terminal posture correcting device 9 can be moved independently of each other.

FIGS. 13 to 17 show the detailed structure of the chuck pieces 52. FIGS. 13A and 13B show the shape of an inclined guide portion (scooping portion) 63 for passing and guiding the terminal 16 through the pair of chuck pieces 52. The open angle α formed by both tapering guide portions 63 is set for 70°. The angle of 70° is the sum of two angles of 35° on both sides (30° is a tapering angle of the one side tapering guide portion 63 where the member such as a terminal is smoothly guided in a sliding manner and 5° represents clearance).

Theoretically, although the open angle of 60° of the inclined guide portion 63 is best, in an actual use, 70° or less can be preferably adopted (the range of 50°–80° can be used for the following reason. (1) As shown in FIG. 13, the protrusion length A from the electric wire clamp 7 on the high speed transfer belt 8 to the wire crimping portion 16*a* of the terminal 18 is about 40–45 mm, and the bending width S in a horizontal direction in the wire crimping portion 16*a* of the terminal 18 is about 20 mm in the maximum. (2) When the open angle α is too small, the height of the chuck pieces 52 is increased and the number of rising/falling strokes by the two-stage cylinder 54 is increased, thus giving rise to bad influence of increasing the time required for rising/falling and enlarging the equipment. (3) When plural pairs of chuck pieces 52 are arranged, it is desired that the pitch between the chuck pieces 52 is made small. Incidentally, the above angle is sufficient to clear the bending width S of the terminal. In addition, it should be noted that the tip of each of the chuck pieces 52 is provided with an R portion (roundness) 64 for preventing the terminal from being damaged in rising.

Figure 14A:
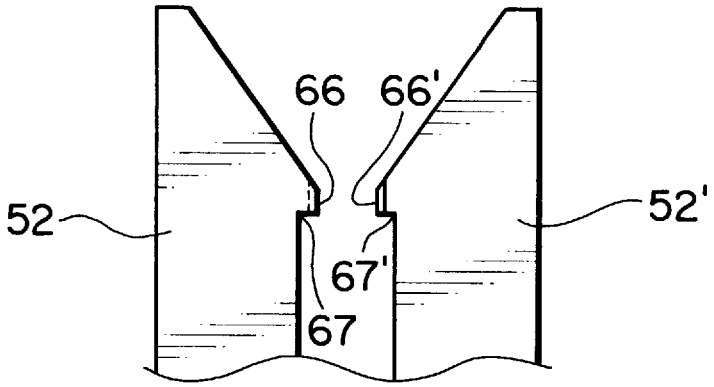
FIGS. 14A and 14B are a front view of the open state of exemplary chuck pieces, and a plan view thereof viewed from bottom, respectively.
Figure 14B:
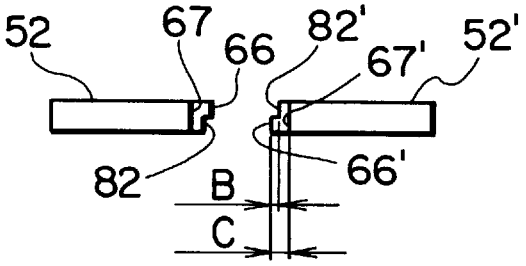
Figure 15A:
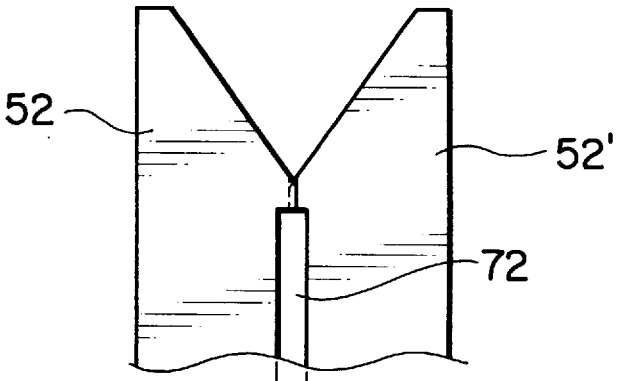
FIGS. 15A and 15B are a front view of the closed state of the exemplary chuck pieces, and a plan view thereof, respectively.
Figure 15B:
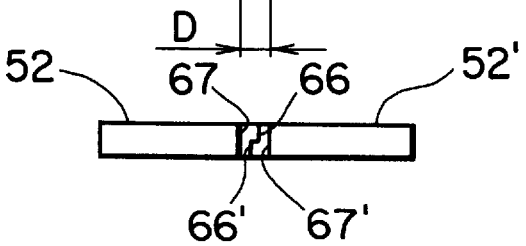

FIGS. 14 to 15 show the shape of terminal stopping steps 67, 67' for a pair of chuck pieces 52 and 52'. A protrusion 66 forming the stopping step 67 of the one chuck piece 52 and a protrusion 66' forming the stopping step 67' of the other chuck piece 52' are provided in an offset manner. In a state where the pair of chuck pieces 52, 52' are in contact with each other, the protrusions 66 and 66' are engaged with concave portions 82 and 82' successive to the protrusions 66 and 66' so that the size of the gap 72 between the pair of chuck pieces 52 and 52' is narrowed by the degree B that the protrusions 66 and 66' are overlapped. The left and right chuck pieces 52 and 52' have the same shape when either one of them is rotated by 180°. For example, assuming that the protrusion length C of the protrusions 66, 66' of the chuck pieces 52, 52' in FIG. 14 is set for 1.2 mm and the depth of the concave portions 82, 82' is set for 0.5 mm, in FIG. 5, the size D of the gap is 1.2+1. 2−0.5=1.9 (mm).

This structure can increase the protrusion length C of the terminal stopping steps 67 and 67' so that the large R-shape angular portion 83 of the wire crimping portion 16*a* of the terminal 16 as shown in FIG. 16(*a*) can be surely abutted on the terminal stopping steps 67 and 67' in FIG. 14. In addition, when the terminal 16 as shown in FIG. 16B is rotated by 90° to be inserted into the connector housing 34, a wire crimping portion 16*a'* having a small thickness can be caught or positioned in the gap between a pair of chuck pieces in contact with each other as shown in FIG. 15.

FIG. 17 shows another shape of the chuck piece in which the terminal stopping step 67 is provided with a stopping face 67*a* inclined upward. The stopping face 67*a* is inclined in taper as the its height gradually increases in a terminal inserting direction. The inclination angle θ of the inclined stopping face 67*a*, although it depends on the scooping width (height) of an upper guide surface 81 (FIG. 20) of the terminal guide pieces 32 of the terminal insertion head 5 and the entire length of the terminal guide pieces 32, is preferably about 2° to implement smooth terminal insertion. This inclination angle θ corresponds to the inclination angle of the tip surface 71*a* of the terminal supporting protrusion 71 of the above terminal holder 55.

Figure 18A:
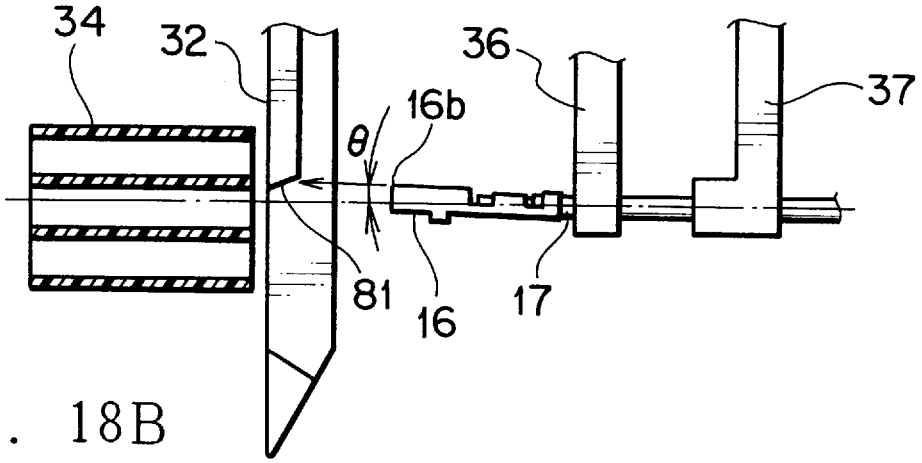
FIGS. 18A to 18C are side views showing steps of a process of inserting a terminal along the guide face in a connector housing, respectively.
Figure 18B:
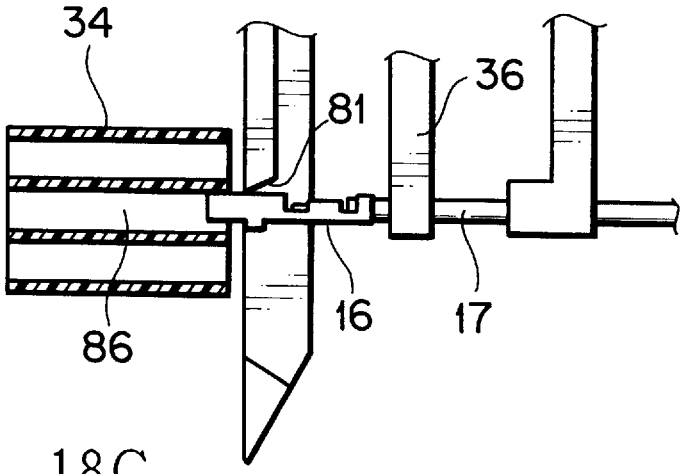
Figure 18C:
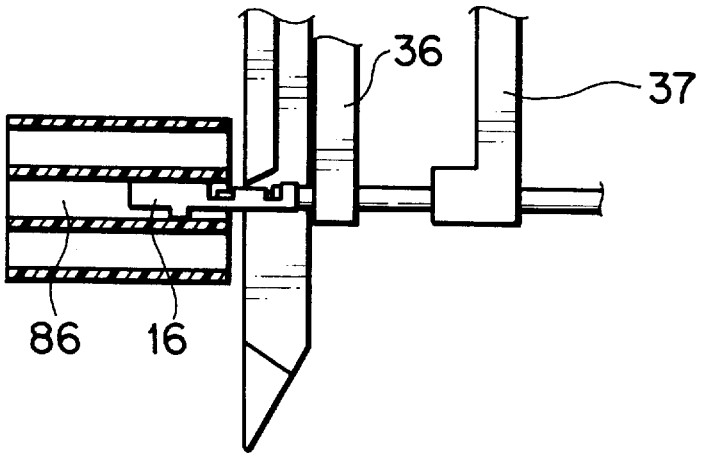

The terminal 16 is supported by 2° upward by the inclined stopping face 67*a* of the terminal stopping step 67 and the inclined abutting face 71*a* of the terminal supporting protrusion 71. As shown in FIG. 18A, the terminal end 18 is caught in its area immediately after the wire 17 and an area continuouse thereto by the wire catching hands 36 and 37. Simultaneously, the chuck pieces 52 are opened to release the terminal end 18. Thus, the wire catching hands 36 and 37 advance the terminal 16 in its upward inclined state toward the terminal guide pieces 32. The upper tip 16*b* of the terminal 16 abuts on the center of the upper guide face 81 in its height direction, and slides downward along the upper guide face 81. Thus, the terminal 16 is guided into the terminal chamber 86 of the connector housing 34 as shown in FIG. 18B. In this state, the terminal 16 and the wire 17 are aligned linearly. Further, as shown in FIG. 18C, the front wire catching hand 36 is released and the terminal 16 is completely inserted into the chamber 86 by the shifting operation of the rear wire catching hands 37.

Figure 19A:
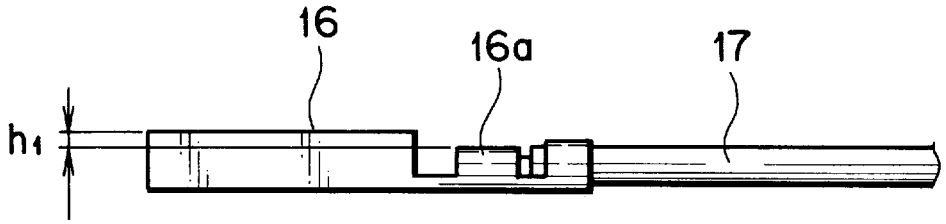
FIGS. 19A and 19B are side views showing a terminal in a horizontal state, and a side view showing its 90° inverted state, respectively.
Figure 19B:
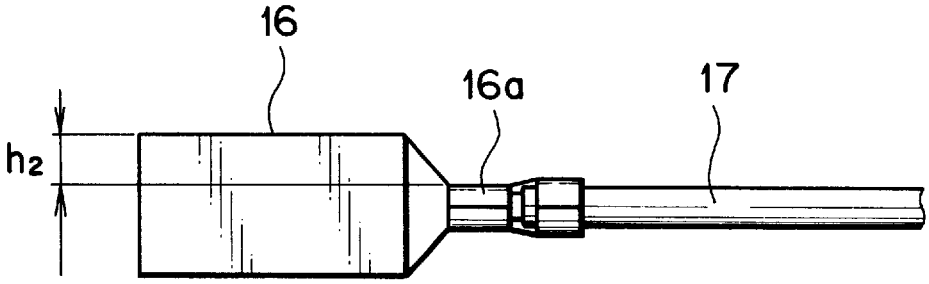
Figure 21B:
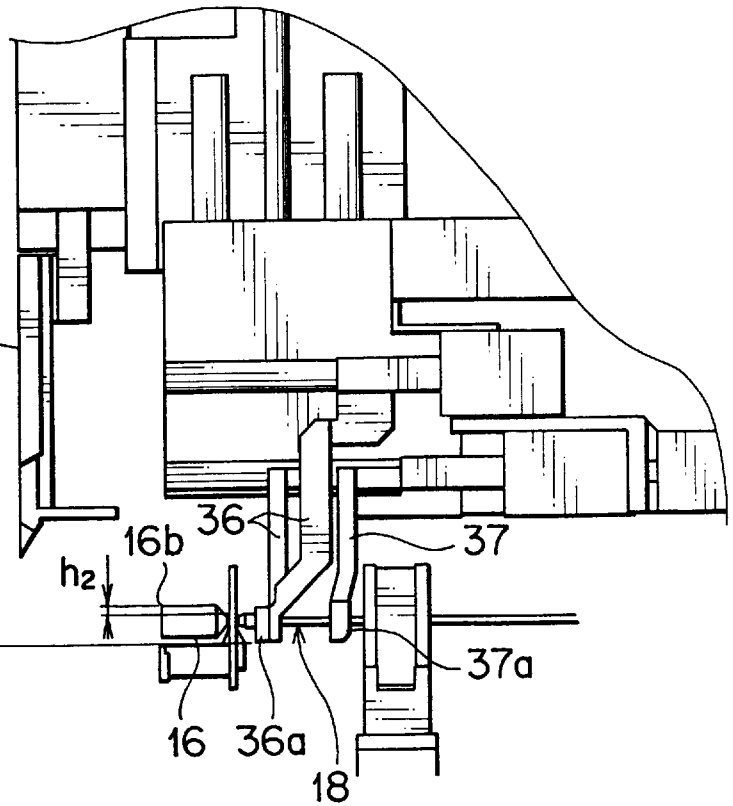
FIGS. 21A and 21B are side views showing a difference in the Z-axis direction catching positions of a horizontal terminal and an inverted terminal, respectively.
Figure 21A:
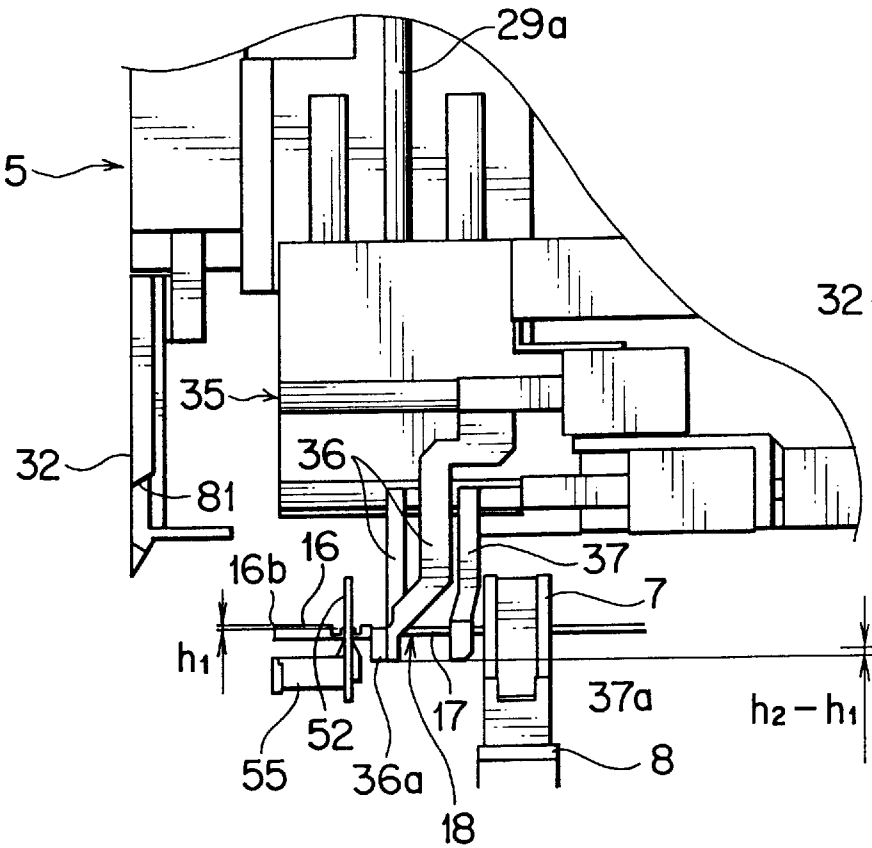
Figure 22B:
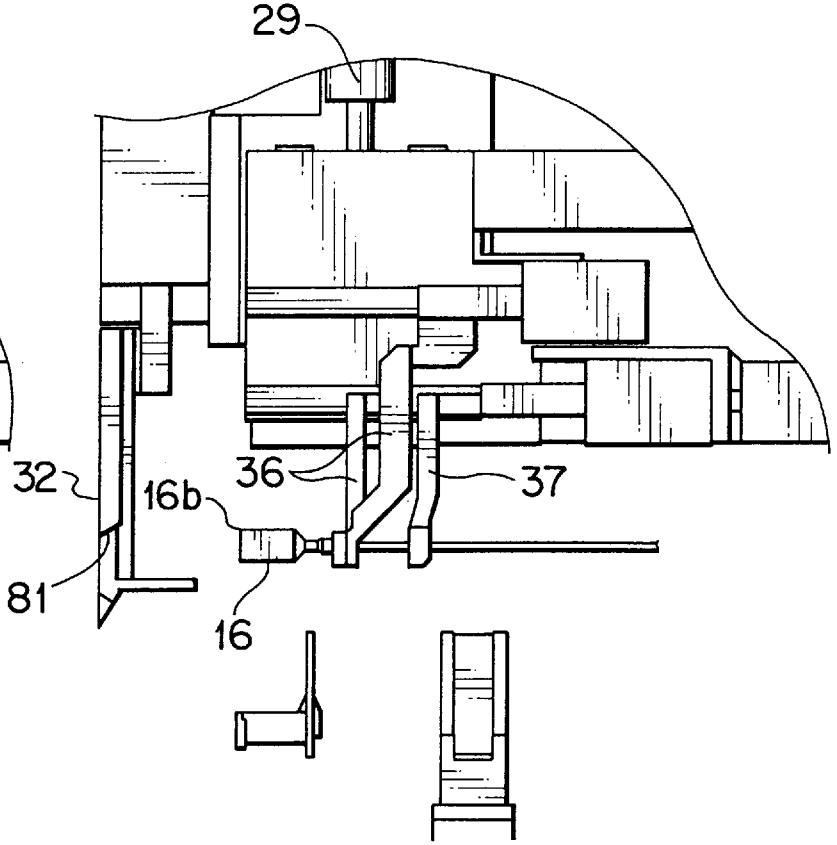
FIGS. 22A and 22B are the same side views as FIGS. 21A and 21B when the terminals are located oppositely to the guide face, respectively.
Figure 22A:
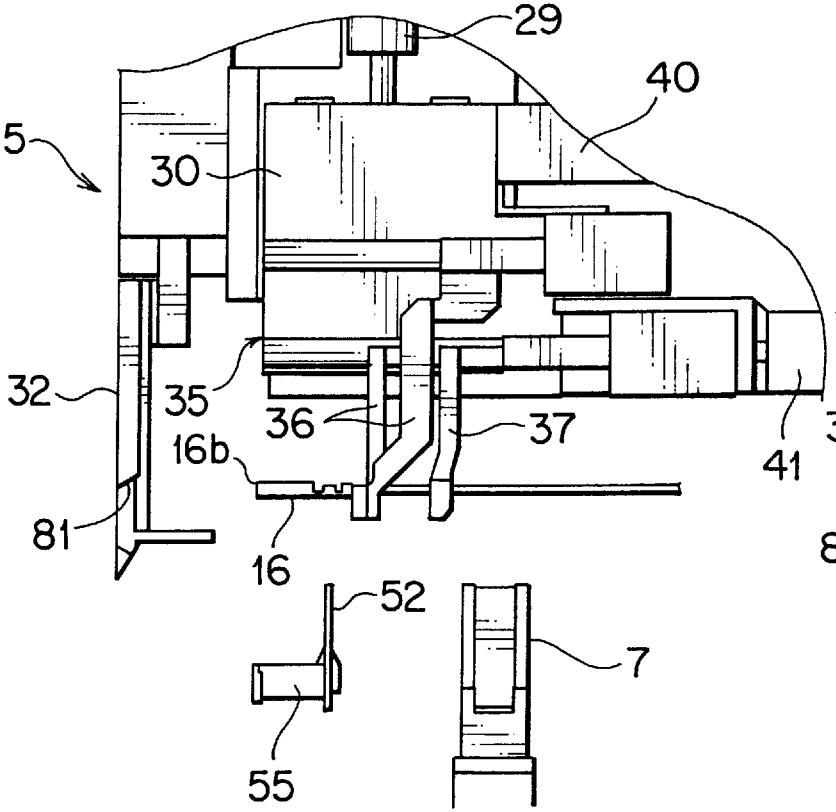

FIGS. 21 and 22 show a method of abutting the tip of the terminal 16 having various sizes on the center of the upper guide face 81 of the terminal guide pieces 32 in its height direction. For example, in the case where the terminal 16 is inserted with its horizontal posture as shown in FIG. 19A, the distance from the wire crimping portion 16*a* to the upper face of the wire 16 is hi whereas in the case where the terminal 16 is inserted with its vertical posture rotated by 90° as shown in FIG. 19B, it is $h_2$. These distances $h_1$ and $h_2$ are greatly different from each other. The accuracy of the size of the wire crimping portion 16*a* is very high because it is compression-molded between an anvil (lower die) and crimper (upper die) which are not shown. For this reason, the chuck pieces 52 are also adapted to catch the wire crimping portion 16*a*.

Figure 20:
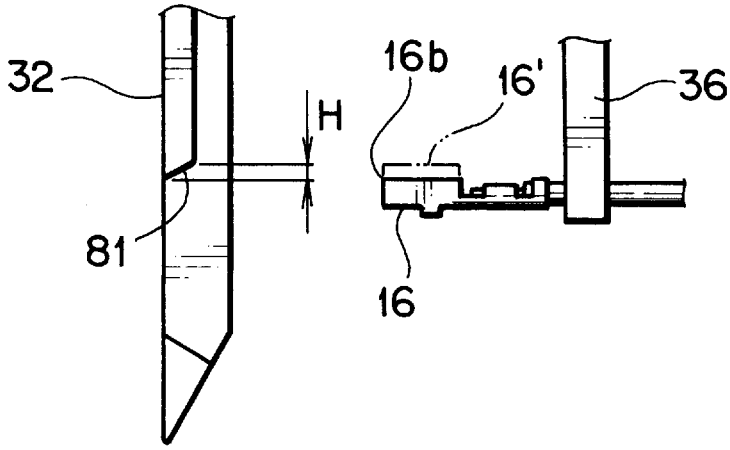
FIG. 20 is a side view of the upper tip position of each terminal for a guide face.

When the terminal 16 in each of the above cases is guided to the upper guide faces 81 of the terminal guide pieces 32 without considering the difference H between the distances hi and h2 from the wire crimping portion 16*a* to the terminal upper face, as shown in FIG. 20, the upper tip 16*b* of the horizontal terminal 16 is located at the lower end of the upper guide face 81 and that of the vertical terminal 16 is located at the upper end of the upper guide face 81. As a result, owing to possible changes of the position of the terminal 16, the terminal 16 may not be guided to the upper guide face 81. This may occur for not only the 90° inverted terminal but various terminals having different sizes.

In order to obviate such a disadvantage, as shown in FIGS. 21A and 21B, when the terminal insertion head 5 (see FIGS. 1 and 3) goes to the wire clip 7 to take the terminal 18 on the transfer belt 8, the positions of the wire catching hands 36 and 37 in their height direction are changed using the ball screw unit 27 by servo-drive in the Z-axis direction (FIGS. 1 and 3) so that the 90° inverted terminal 16 and the terminals having different sizes can dealt with.

Specifically, for the terminal 16 as shown in FIG. 21(*a*), the ball screw unit 27 is driven in a great degree to lower the wire catching hands 36 and 37 more downward so that the terminal 18 is caught by the upper portions of the catching portions 36*a* and 37*a* at the tips of the wire catching hands 36 and 37. On the other hand, for the vertical 90°-inverted terminal 16 having a large height $h_2$ as shown in FIG. 21B, the ball screw unit 27 is lowered in a slight degree to raise the lowering position of the wire catching hands 36 and 37 slightly so that the terminal end 18 is caught by substantially the centers of the wire catching hands 36 and 37.

Thus, as shown in FIG. 22, when the wire catching hand unit 35 (inclusive of the vertical substrate 30 and the wire catching hand shifting cylinders 40 and 41) is risen by a prescribed stroke by the vertical cylinder 29, the respective upper tips 16*b* of the horizontal terminal 16 as shown in FIG. 22(*a*) and the 90°-inverted terminal and other terminals having a different height can be located oppositely to the center of the upper guide faces 81 of the terminal guide pieces 32.

Positioning by the ball screw unit 27 is carried out accurately by the servo motor 28 (FIG. 1). The position of the terminal insertion head 5 in the Z-axis direction can be changed in such a manner that positioning data are previously stored in the apparatus considering the difference H between the terminals 16 in their height direction. Thus, since the upper tip of the terminal 16 can be always located at the center of the upper guide face 81, even when the terminal 16 has fluctuating postures in the height direction, the terminal 16 can be surely guided along the upper guide face 81 so that it can be surely inserted into a desired terminal chamber 86 of the connector housing 34. Further, even if the size of the terminal 16 varies, the tip of the terminal 16 can be located at the center of the upper guide face 81 so that the terminal 16 having various sizes can be dealt with, thus improving versatility therefor.

FIGS. 23 to 26 illustrate the movement of the ball screw unit 27 in the Z-axis direction and its terminal insertion operation.

Figure 23:
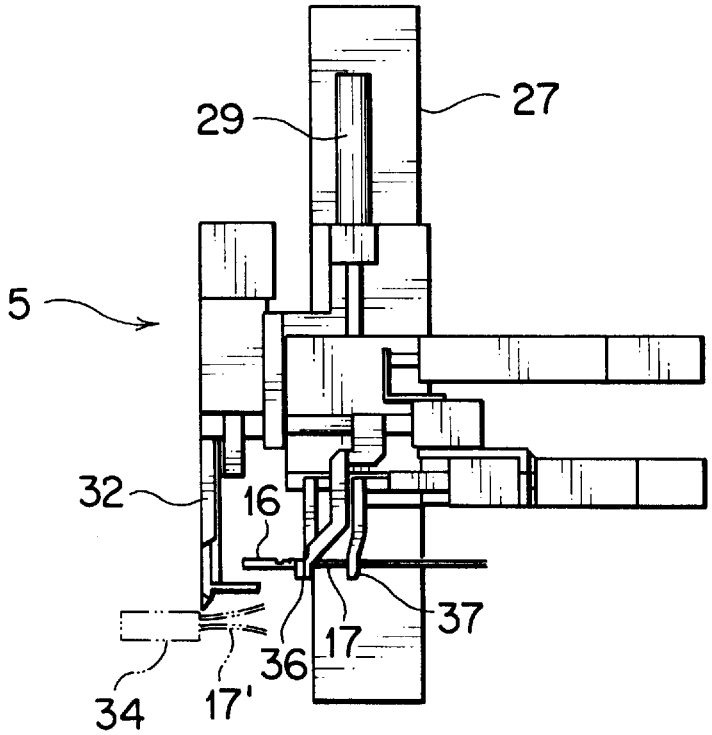
FIG. 23 is a side view showing the state where a terminal insertion head has been moved in a Z-axis direction.
Figure 24:
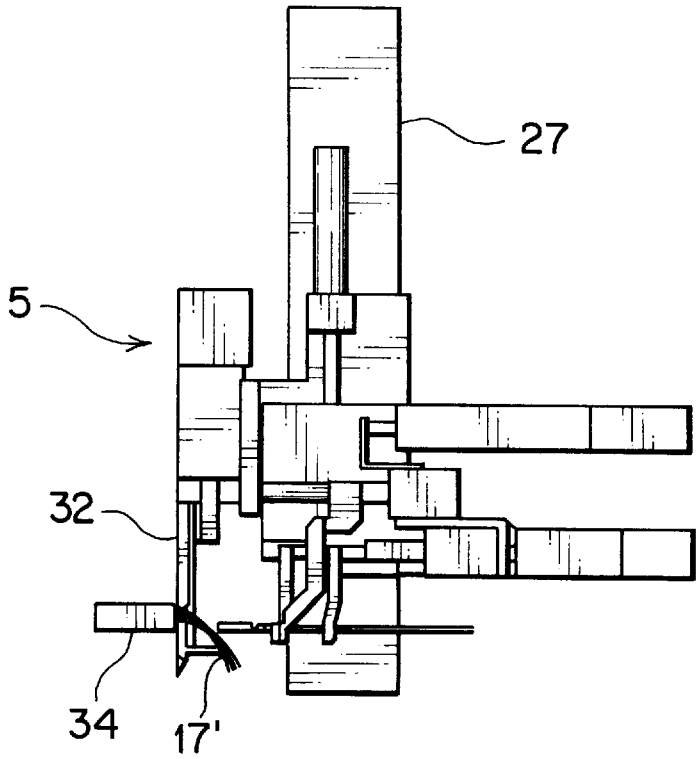
FIG. 24 is a side view showing the state where the terminal guide piece shares the wires forcibly.

In FIG. 3, the ball screw unit 27 by servo drive in the Z-axis direction lowers the terminal head 5 and also the rod 29*a* of the vertical cylinder (which is a cylinder for shifting the wire catching hands in the Z-direction) 29 lowers the wire catching hands 36 and 37 by its maximum degree extending operation. As shown in FIG. 23, from this state, the ball screw unit 27 raises the terminal insertion head 5 itself, thereby catching the terminal end by the wire-catching hands 36, 37, and also the vertical insertion cylinder 29 is compressed to a maximum degree. Further, the terminal insertion head 5 is advanced along the Y-axis beam (FIG. 1) so that the terminal guide pieces 32 are located above the wires introduced from the connector housing 34. Subsequently, as shown in FIG. 24, the ball screw unit 27 lowers the terminal insertion head 5 again so that the terminal guide pieces 32 are located among the introduced wires, thereby causing the pair of guide pieces 32 to share the wires by their opening operation forcibly.

Figure 25:
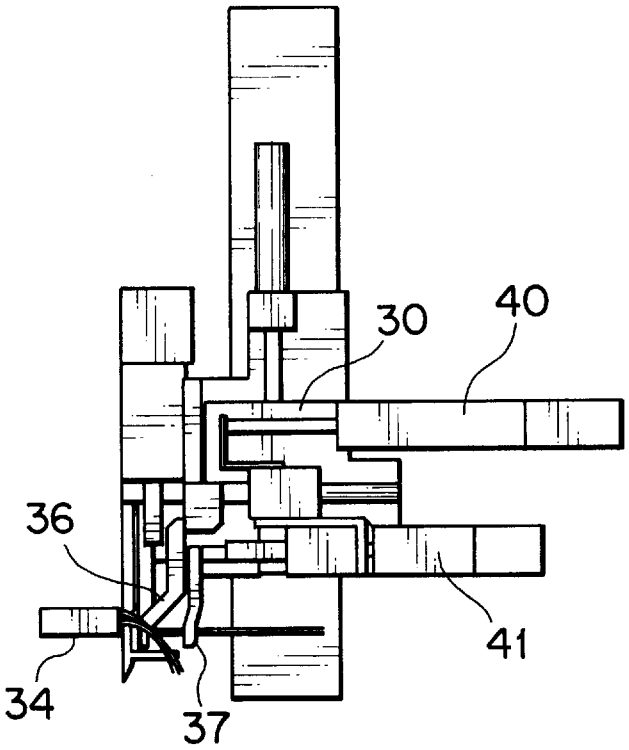
FIG. 25 is a side view where a terminal has been primarily inserted in a connector housing.
Figure 26:
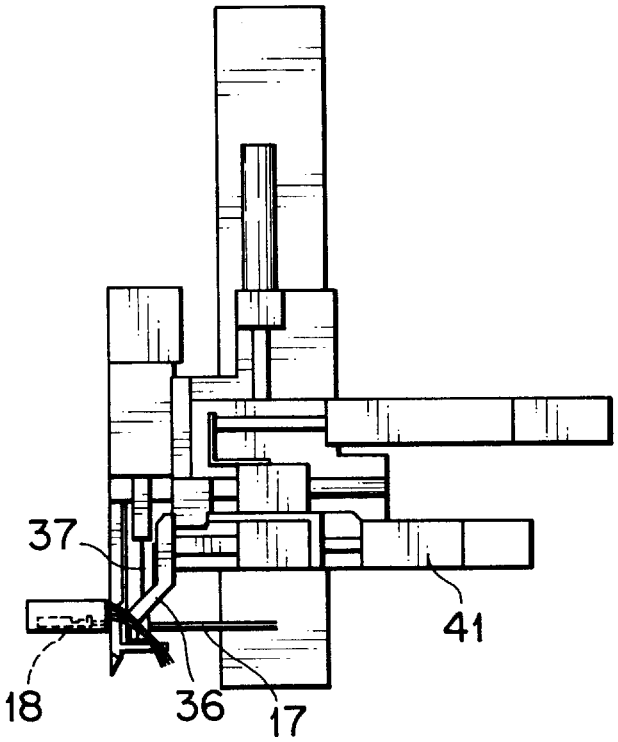
FIG. 26 is the side view where the terminal has been secondarily inserted.

Next, as shown in FIG. 25, the upper horizontal cylinder which serves to shift the wire catching hands 40 primarily is extended to advance the wire catching hands 36 and 37 together with the vertical cylinder 30 so that only the terminal 16 is primarily inserted into the connector housing 34. Further, as shown in FIG. 26, the front wire catching hands 36 are released to extend the lower horizontal cylinder 41 which serves to shift the wire catching hands secondarily so that the wire 17 is pushed by only the rear catching hands 37 to insert the terminal end 18 into the connector housing 34.

Figure 27A:
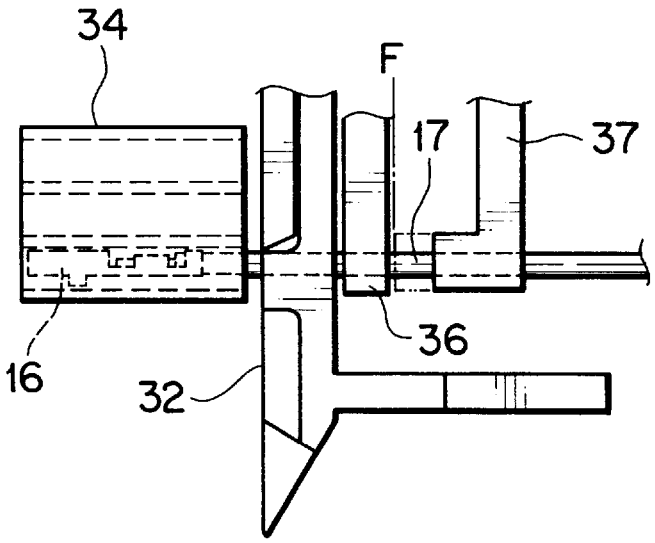
FIGS. 27A and 27B are a side view showing shift shortage of the wire catching hands and a side view showing where a wire has been buckled.
Figure 27B:
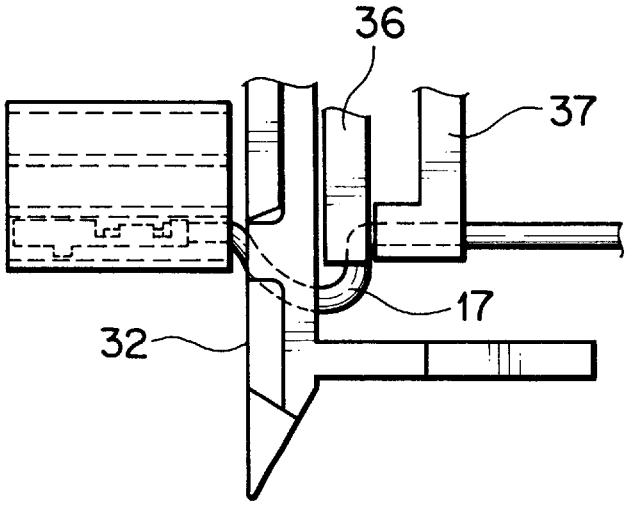

FIG. 27 shows the state where the terminal 16 has been completely inserted into the connector housing 34 through the terminal guide pieces 32. In order to carry out terminal insertion completely, the rear wire catching hands 37, while bending the wire 17, advances to the position where the wire 17 is brought into contact with the front wire catching hand 36. At this position F, the horizontal cylinder 41 stops in response to a stroke end signal (Incidentally, when a successive operation program by a sequence timer not requiring the stroke end signal is adopted, a next operation will be carried out without recognizing shortage of insertion of the terminal 16). However, when the wire 17 is hard because of a winter season or its small diameter, the wire 17 will not warp buckle so that the stroke end signal cannot be obtained. A too excessive amount of warp of the wires hinders the wire guide pieces 32 to share the wires forcibly.

Figure 28:
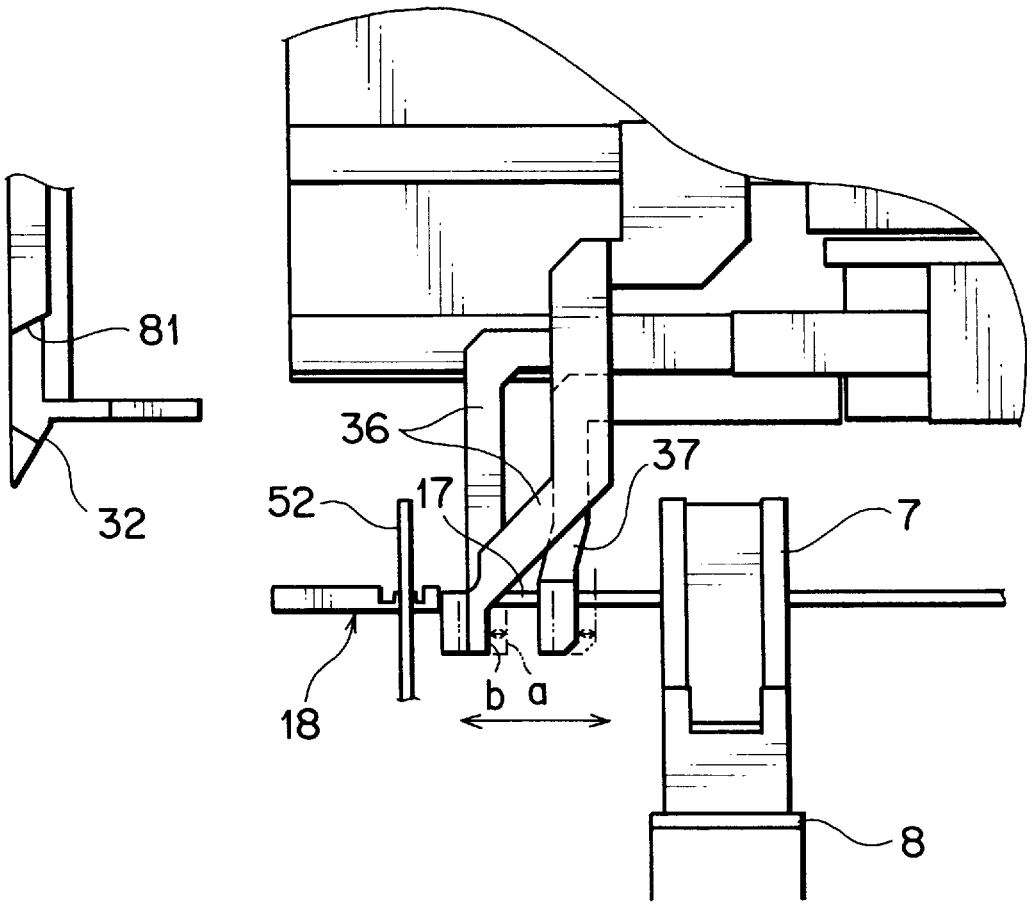
FIG. 28 is a side view showing the state where the horizontal positions of the terminal catching hands have changed to catch the terminal.
Figure 29:
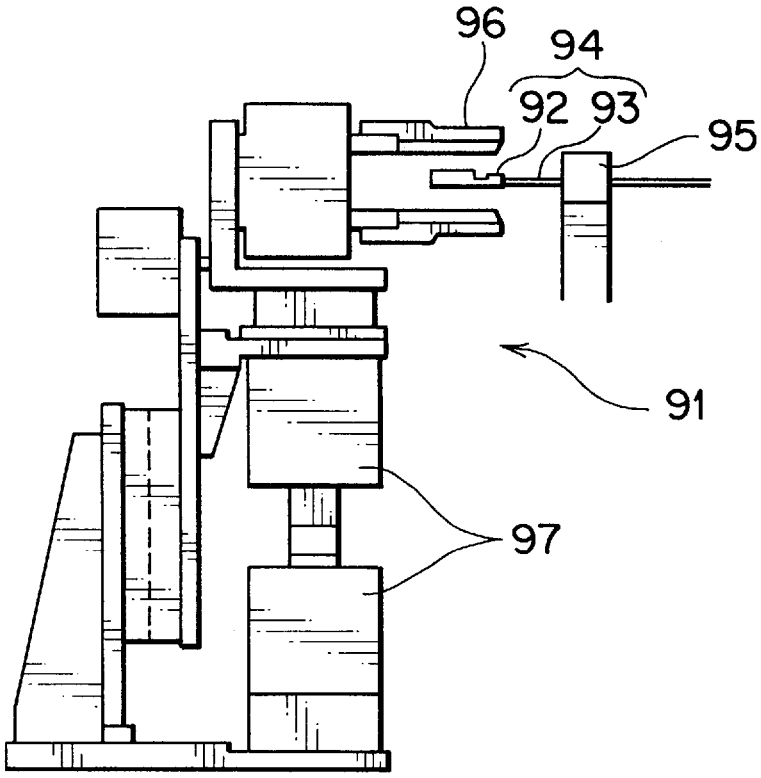
FIG. 29 PRIOR ART
FIG. 29 is a side view showing a conventional terminal posture correcting device.
Figure 30:
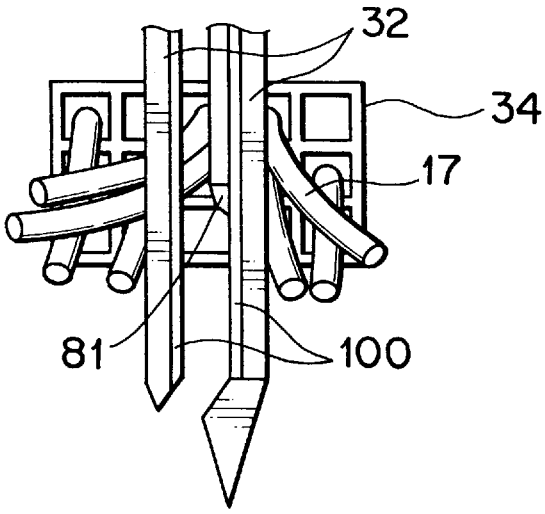
FIG. 30 PRIOR ART
FIG. 30 is a background view showing the state where the terminal guide pieces have forcibly shared wires.
Figure 31A:
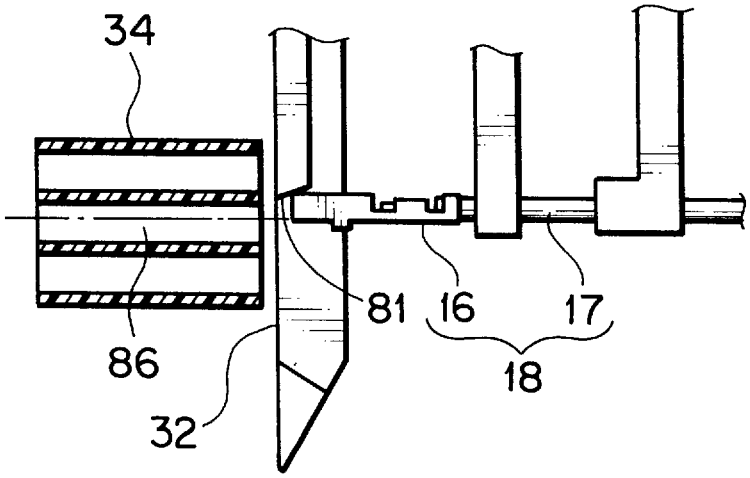
FIG. 31A PRIOR ART
FIGS. 31A and 31B are side views showing steps of a conventional terminal insertion method, respectively.
Figure 31B:
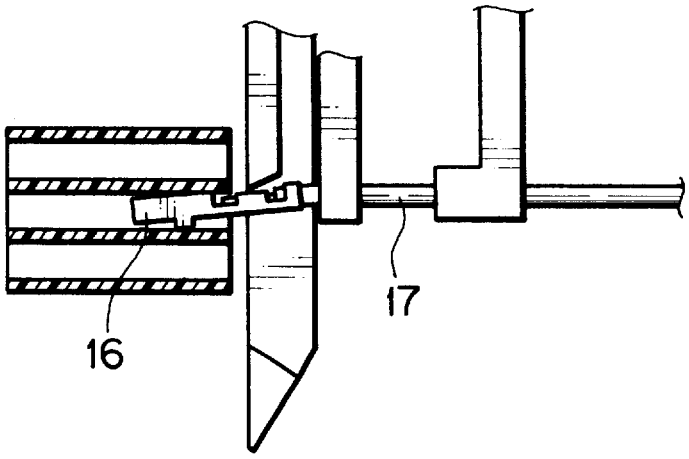
FIG. 31B PRIOR ART

In order to obviate such a disadvantage, before the terminal end is caught by the wire catching hands 36 and 37, the terminal insertion head 5 is shifted along the Y-axis beam 4 shown in FIG. 1 by a small degree by drive by the servo motor 22 and the timing belt 19. Thus, when the wire catching hands 36 and 37 of the terminal insertion head 5 receives the terminal end 18 clamped, as shown in FIG. 28, by the chuck pieces 52 and the wire clamp 7 on the high speed transfer belt 8, the catching positions of the wire catching hands 36 and 37 in a terminal insertion direction can be changed from a broken-line position a to a solid-line position b.

Since the terminal insertion head 5 is positioned accurately in a terminal insertion direction by the servo-motor 22 (FIG. 1), an insufficient stroke of the cylinders 40 and 41 can be accurately compensated for. Thus, without setting the warping margin of the wire 17 or margin of the terminal insertion amount, the terminal 16 can be surely inserted into the connector housing 34. Thus, stopping of the apparatus attributable to that the stroke end signal is not obtained or poor pushing of the wires by the terminal guide pieces 32 due to the warp of the wire 17 can be prevented. Since it is not necessary to warp the wire 17, as shown in FIG. 28, the immediate rear of the terminal 16 can be caught by the front wire catching hands as shown in FIG. 28. Thus, bending of the terminal end 18 when and after the terminal is caught can be prevented, thus permitting more sure terminal insertion. Further, if the shifting amounts in the Y-axis direction of the terminal insertion head 5 are previously input in accordance with the kinds of the terminal 16 and the connector housing 34, various terminals 16 can be surely inserted into several connector housings 34, thus greatly improving versatility.

Additionally, since the two-stage switching cylinder (cylinders 40 and 41) (JP-A-6-89507) for shifting the wire catching hands 36 and 37 in the terminal insertion direction can provide only a certain amount (two to four strokes), it is not possible to make the position adjustment in the Y-axis direction. Use of both the shifting operation of the Y-axis beam 4 together with and the above two-stage cylinder permits the terminal insertion to be more effectively. The Y-axis beam 4 inherently serves to cause the terminal insertion head 5 approach the connector housing 34 held by the connector holding unit 6, but is also used for adjustment of the terminal insertion amount as in the example.

What is claimed is:

1. A terminal insertion apparatus comprising:

a Y-axis beam movable by servo drive along an X-axis beam;

a terminal insertion head having wire catching hands and a terminal guiding piece and slidably engaged with said Y-axis beam, said terminal insertion head being movable toward a connector housing by servo drive;

a high speed transfer belt having an electric wire clamp for clamping a wire of a terminal end and being movable in the X-axis direction by servo drive; and a terminal posture correcting device located at a forward position of a transfer head in a terminal insertion direction of said electric wire clamp, being movable by servo drive in a direction in parallel to that of said high speed transfer belt, said terminal posture correcting device including a pair of chuck pieces for chucking a terminal of the terminal end clamped by said wire clamp and deliver said terminal end to said wire catching hands and a terminal holder movable in a direction perpendicular to the opening/closing direction of said terminal chuck pieces.

2. A terminal insertion method using the terminal insertion device according to claim 1, comprising the steps of:

shifting a high speed transfer belt, locating said wire clamp behind a required one of a plurality of connector housings arranged on a pallet;

shifting said posture correcting device towards said wire clamp simultaneously with the shifting of the high speed transfer belt so that said terminal chuck pieces are positioned opposite the front of said wire clamp so that the posture of the terminal, of the terminal end whose wire is clamped by said wire clamp, is two-dimensionally corrected by said terminal chuck pieces and said terminal holder of said terminal posture correcting device;

causing said wire catching hands to receive said terminal from said terminal chuck pieces;

moving said terminal insertion head to a vicinity of the required connector housing along said Y-axis beam; and advancing said wire catching hands to insert the terminal into the required connector housing along the terminal guide pieces of said terminal insertion head.

3. A terminal posture correcting device comprising:

a pair of terminal chuck pieces, each including a straight inner side face which can catch a terminal of a terminal end, a terminal stopping step perpendicular to said inner side face and an inclined guide portion for terminal introduction formed form said terminal stopping step to a tip of the terminal chuck piece; and a terminal holder which is movable along said pair of terminal chuck pieces and can hold the terminal between said terminal holder and said terminal stopping step.

4. A terminal posture correcting device according to claim 3 further comprising:

a first cylinder for said opening/closing said chuck pieces;

a second cylinder for shifting said terminal holder along said first cylinder;

a third cylinder for shifting said first and said second cylinder integrally in a terminal insertion direction of the terminal end clamped by an external wire clamp, whereby said chuck pieces can be located at three positions for said terminal by an expansion/contraction operation of said third cylinder.

5. A terminal posture correcting method using the terminal posture correcting device according to claim 4, comprising the steps:

by contracting said third cylinder to a maximum degree, positioning inclined guide portions of a pair of chuck pieces oppositely in a direction perpendicular to that of a terminal of a terminal and whose wire clamped by a wire clamp;

extending said third cylinder to a maximum degree and passing said terminal between said pair of terminal chuck pieces;

applying a pressure to said first cylinder so as to close said pair of terminal chuck pieces so that the posture of said terminal is corrected in a width direction; and placing said first cylinder in an exhaust center state to release a chucking force of said terminal chucking pieces so that by an intermediate contraction operation of said third cylinder, the terminal stopping steps of said pair of terminal chuck pieces are caused to abut on the one end of said terminal and by said second cylinder, and said terminal holder is caused to abut on the other end of said terminal, thereby correcting the posture of said terminal in a height direction.

6. A terminal posture correcting method according to claim 5, fuher comprising the steps of:

by said wire catching hands, catching the wire of the terminal end whose terminal is chucked by said terminal chuck pieces, thereby releasing urging force of said terminal holder; and opening said terminal chucking pieces to move said terminal insertion head in from of a connector housing and advance said wire catching hands so that the terminal is inserted into said connector housing along said terminal guide pieces.

7. A terminal posture correcting device according to claim 3, wherein said terminal holder is located before and after said terminal chuck pieces in a direction of a plate thickness and extends to traverse a gap between said pair of terminal chuck pieces in an opening state, and includes a pair of terminal supporting rods each movable toward said terminal stopping step and a terminal supporting protrusion provided in one of said terminal supporting rods and positioned in said gap between said pair of terminal chuck pieces.

8. A terminal posture correcting device according to claim 7, wherein the tip of each of said pair of terminal supporting rods is sharp in a wedge-shape, said terminal supporting protrusion protrudes further in a terminal direction than said pair of terminal supporting rods, and a tip of said terminal supporting protrusion is inclined by about 2° for a guide surface of each of said terminal guide pieces of said terminal insertion head.

9. A terminal posture correcting device according to claim 3, wherein said terminal stopping step is inclined by about 2° for the guide faces of said terminal guide pieces.

10. A terminal posture correcting device according to claim 3, wherein an opening angle of the inclined guide faces of said pair of terminal chuck pieces is not larger than 70°.

11. A terminal posture correcting device according to claim 10, wherein the tips of said inclined guide portions are rounded.

12. A terminal correcting device according to claim 3, wherein protrusions constituting said terminal stopping steps are arranged in a offset manner at the front of the one of said terminal chuck pieces and the rear of the other thereof, respectively, in a direction of their plate thickness, and when both terminal chuck pieces are closed, both protrusions thereof overlap to decrease the gap between both terminal chuck pieces.

13. A terminal posture correcting device according to claim 3, wherein said terminal chuck pieces and said terminal supporting protrusion have a smaller thickness than the length of a wire crimping portion of the terminal so that they support the wire crimping portion of the terminal.

14. A terminal posture correcting method comprising the steps of:

advancing a pair of terminal chuck pieces in a direction perpendicular to that of a terminal of a terminal end, a wire of which is clamped by a wire clamp to pass the terminal through said pair of terminal chuck pieces;

closing said terminal chuck pieces to chuck the terminal;

releasing a chucking force of the terminal chucking pieces;

retreating said terminal chuck pieces in a direction perpendicular to the terminal so that the terminal abuts on a terminal stopping step of each of said terminal chuck pieces;

advancing a terminal holder toward to said terminal; and holding said terminal between said terminal stopping step and said terminal holder.

15. A terminal insertion method comprising the steps of: shifting a terminal insertion head having wire catching hands and terminal guide pieces in a Z-axis direction by a ball screw unit by servo drive; catching a terminal clamped by an external wire clamp by said wire catching hands; moving the terminal in a Z-axis direction by contracting a cylinder for shifting said wire catching hand; and inserting the terminal of said terminal end along terminal guide pieces, wherein when said terminal insertion head catches the terminal end clamped by said wire clamp by operation of the ball screw unit, and the amount of shifting said ball screw unit is changed in accordance with a distance in the Z-axis direction form a tip of said wire to the center position of the guide faces of said guide pieces so that the tip of said terminal after said cylinder contracts said wire by a prescribed length is positioned at a center of said guide face.

16. A terinal insertion method comprising the steps of: shifting a terminal insertion head, having a wire catching hand and a cylinder for shifting the terminal insertion head in a Z-axis direction, so that a terminal end clamp by an external wire clamp is caught and taken up by said wire catching hands, and shifting said wire catching hand by said cylinder in a Y-axis direction to insert the terminal of said terminal end into the connector housing, wherein said terminal insertion head is movable by servo drive along the Y-axis beam; before the end terminal clamped by said wire clamp is caught by said wire catching hands, said terminal insertion head is shifted, in accordance with the Y-axis length of the terminal and connector housing by servo drive along the Y-axis beam so that the terminal catching position in the Y-axis direction by said wire catching hand is defined, thereby acquiring a complete terminal insertion stroke based on a total of a stroke of said cylinder and the shifting amount of said terminal insertion head.

* * * * *